US010801491B2

(12) United States Patent
Urdaneta et al.

(10) Patent No.: US 10,801,491 B2
(45) Date of Patent: Oct. 13, 2020

(54) CEPSTRUM ANALYSIS OF OILFIELD PUMPING EQUIPMENT HEALTH

(71) Applicant: SCHLUMBERGER TECHNOLOGY CORPORATION, Sugar Land, TX (US)

(72) Inventors: Carlos Urdaneta, Houston, TX (US); Jijo Oommen Joseph, Houston, TX (US); Hao Lam, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 491 days.

(21) Appl. No.: 15/326,752

(22) PCT Filed: Jul. 21, 2015

(86) PCT No.: PCT/US2015/041264

§ 371 (c)(1),
(2) Date: Jan. 17, 2017

(87) PCT Pub. No.: WO2016/014476

PCT Pub. Date: Jan. 28, 2016

(65) Prior Publication Data

US 2017/0211569 A1 Jul. 27, 2017

Related U.S. Application Data

(60) Provisional application No. 62/028,147, filed on Jul. 23, 2014.

(51) Int. Cl.
*F04B 51/00* (2006.01)
*F04B 53/00* (2006.01)
(Continued)

(52) U.S. Cl.
CPC ..... *F04B 51/00* (2013.01); *F04B 49/065* (2013.01); *F04B 53/00* (2013.01); *E21B 43/26* (2013.01); *F04B 2201/1208* (2013.01)

(58) Field of Classification Search
CPC ..... F04B 51/00
See application file for complete search history.

(56) References Cited

U.S. PATENT DOCUMENTS 4,226,404 A * 10/1980 Zens ..... F04B 47/04 187/404
5,792,967 A * 8/1998 Steber ..... B25B 21/005 73/862.23

(Continued)

FOREIGN PATENT DOCUMENTS

RU 1784851 C 12/1992

OTHER PUBLICATIONS

International Search Report issued in International Patent Application No. PCT/US2015/041264 dated Sep. 24, 2015; 3 pages.

(Continued)

*Primary Examiner* — Hyun D Park
(74) *Attorney, Agent, or Firm* — Rodney Warfford

(57) ABSTRACT

The present disclosure introduces apparatuses and methods for assessing health of oilfield pumping equipment. An example pump assembly health monitoring system receives angular position data, including angular positions associated with operation of the pump assembly, and parameter data, including values of a parameter associated with the pump assembly that fluctuates with the angular positions. The monitoring system determines a cepstrum of the parameter data with respect to the angular position data, and determines a ratio of a first amplitude of the cepstrum at a quefrency of about zero to a second amplitude of the cepstrum at a non-zero quefrency. The determined ratio is indicative of a health of a component of the pump assembly.

20 Claims, 9 Drawing Sheets

(51) Int. Cl.
*F04B 49/06* (2006.01)
*E21B 43/26* (2006.01)

(56) References Cited

U.S. PATENT DOCUMENTS

| | | | | |
|---|---|---|---|---|
| 5,825,657 | A | 10/1998 | Hernandez | |
| 6,484,109 | B1 * | 11/2002 | Lofall | G01H 1/003 702/58 |
| 6,547,531 | B1 * | 4/2003 | Cumbo | F04B 1/295 417/222.1 |
| 6,659,200 | B1 * | 12/2003 | Eppink | E21B 4/18 166/381 |
| 7,643,945 | B2 | 1/2010 | Baklanov et al. | |
| 8,401,806 | B2 | 3/2013 | Borstin et al. | |
| 2005/0096873 | A1 * | 5/2005 | Klein | G01H 1/006 702/184 |
| 2005/0180868 | A1 | 8/2005 | Miller | |
| 2007/0083365 | A1 | 4/2007 | Shmunk | |
| 2009/0162186 | A1 | 6/2009 | Christinsen et al. | |
| 2009/0222228 | A1 | 9/2009 | Gao et al. | |
| 2010/0174496 | A1 | 7/2010 | Adnan et al. | |
| 2010/0247335 | A1 * | 9/2010 | Atherton | E21B 43/128 417/53 |

OTHER PUBLICATIONS

Written Opinion issued in International Patent Application No. PCT/US2015/041264 dated Sep. 24, 2015; 10 pages.
Office Action issued in Russian Patent Application No. 2017101828/06(003122) dated Nov. 21, 2017; 20 pages.

* cited by examiner

CEPSTRUM ANALYSIS OF OILFIELD PUMPING EQUIPMENT HEALTH

CROSS-REFERENCE TO RELATED APPLICATIONS

This application claims priority to and the benefit of U.S. Provisional Application No. 62/028,147, titled "Angular Displacement Prognostics and Health Determination of Rotating Devices," filed Jul. 23, 2014, the entire disclosure of which is hereby incorporated herein by reference.

BACKGROUND OF THE DISCLOSURE

In oilfield operations, reciprocating pumps are utilized at wellsites for large scale, high-pressure operations. Such operations may include drilling, cementing, acidizing, water jet cutting, and hydraulic fracturing of subterranean formations. In some applications, several pumps may be connected in parallel to a single manifold, flow line, or well. Some pumps include fluid displacing members driven by a crankshaft toward and away from a fluid chamber to alternatingly draw in, pressurize, and expel fluid from the fluid chamber. Hydraulic fracturing of a subterranean formation, for example, may utilize fluid at a pressure exceeding 10,000 pounds per square inch (PSI).

The success of the pumping operations may be related to many factors, including physical size, weight, failure rates, and safety. Due to high pressures and abrasive properties of certain fluids, sealing components or other portions of the pumps may become worn or eroded. Such defects are often detected late, resulting in pump failures during pumping operations and/or severe damage to the pumps and other equipment. Interruptions during pumping operations may reduce the efficiency of the pumping operations, leading to reduced hydrocarbon production. In some instances, the pumping operations may have to be repeated at substantial monetary costs and loss of production time.

Such consequences make pump maintenance and timely detection of defects a high priority in the oil and gas industry. However, some pump health monitoring systems do not accurately detect or predict pump failures and often generate false alarms, causing problems like unnecessary pump maintenance and interruptions in pumping operations. In preparation for pump failures and other problems, pumping systems may include additional pump assemblies in standby mode, which is a costly measure of preventing interruptions in pumping operations.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a monitoring system for assessing the health of a pump assembly. The pump assembly includes multiple components, including a prime mover and a pump driven by the prime mover. The monitoring system includes communication means for receiving angular position data and parameter data. The angular position data includes angular positions that are associated with operation of the pump assembly. The parameter data includes values of a parameter that is associated with the pump assembly and that fluctuates with respect to the angular positions. The apparatus also includes a processing device operable to determine a cepstrum of the parameter data with respect to the angular position data. The processing device is also operable to determine a ratio of a first amplitude of the cepstrum at a quefrency of about zero to a second amplitude of the cepstrum at a non-zero quefrency. The determined ratio is indicative of a health of one of the pump assembly components.

The present disclosure also introduces a method that includes operating a pump assembly having multiple components, including a prime mover and a pump driven by the prime mover. A processing device is then operated to determine, with respect to an angular position associated with operation of the pump assembly, a cepstrum of a parameter that is associated with the pump assembly and that fluctuates with respect to the angular position. The processing device is also operated to determine a ratio of a first amplitude of the cepstrum at a quefrency of about zero to a second amplitude of the cepstrum at a non-zero quefrency. The method also includes assessing health of one of the pump assembly components associated with the non-zero quefrency based on the determined ratio.

The present disclosure also introduces a method that includes operating a first pump assembly and operating a first processing device to generate a health profile of a first component of the first pump assembly. The health profile is generated by, during a substantial portion of a functional life of the first component: determining, with respect to first angular position data associated with operation of the first pump assembly, a first cepstrum of first parameter data that includes first values of a parameter that is associated with the first pump assembly; determining a first ratio relating a first amplitude of the first cepstrum at a quefrency of about zero to a second amplitude of the first cepstrum at a non-zero quefrency that is associated with the first component; and associating the first ratio with a current health of the first component. The method also includes operating a second pump assembly that is substantially functionally and structurally similar to the first pump assembly. The second pump assembly includes a second component that is substantially functionally and structurally similar to the first component. The method also includes operating a second processing device to: determine, with respect to second angular position data associated with operation of the second pump assembly, a second cepstrum of second parameter data that includes second values of the parameter; and determine a second ratio relating a first amplitude of the second cepstrum at a quefrency of about zero to a second amplitude of the second cepstrum at the non-zero quefrency. The health of the second component is then assessed based on the health profile and the second ratio.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
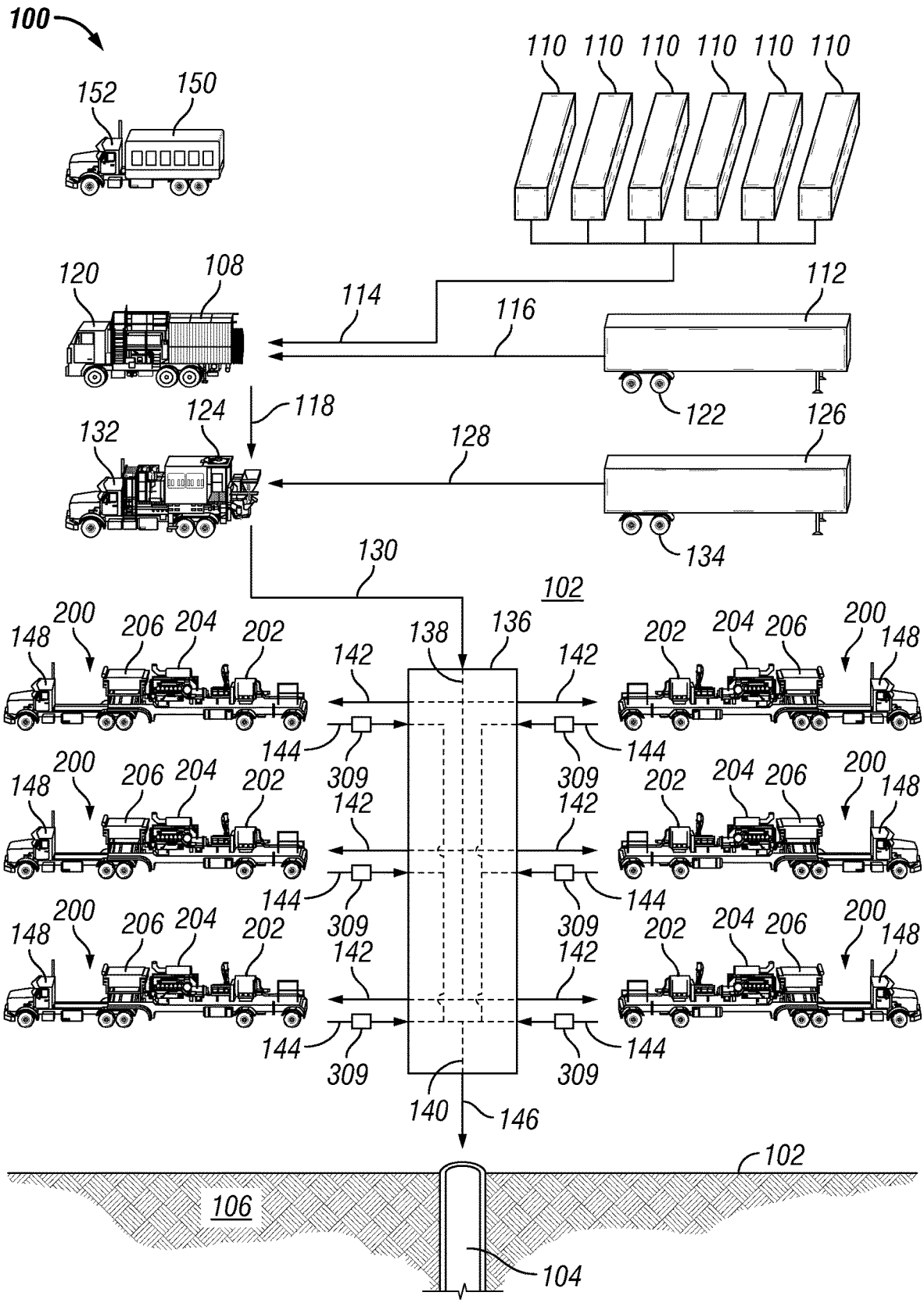
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example pumping system 100 according to one or more aspects of the present disclosure. The figure depicts a wellsite surface 102 adjacent to a wellbore 104 and a partial sectional view of the subterranean formation 106 penetrated by the wellbore 104 below the wellsite surface 102. The pumping system 100 may comprise a first mixer 108 fluidly connected with one or more tanks 110 and a first container 112. The first container 112 may contain a first material and the tanks 110 may contain a liquid. The first material may be or comprise a hydratable material or gelling agent, such as guar, polymers, synthetic polymers, galactomannan, polysaccharides, cellulose, and/or clay, among other examples, and the liquid may be or comprise an aqueous fluid, which may comprise water or an aqueous solution comprising water, among other examples. The first mixer 108 may be operable to receive the first material and the liquid via two or more fluid conduits 114, 116, and mix or otherwise combine the first material and the liquid to form a base fluid. The base fluid may be or comprise that which is known in the art as a gel. The first mixer 108 may then discharge the base fluid via one or more fluid conduits 118.

The first mixer 108 and the first container 112 may each be disposed on corresponding trucks, trailers, and/or other mobile carriers 120, 122, respectively, such as may permit their transportation to the wellsite surface 102. However, the first mixer 108 and/or first container 112 may be skidded or otherwise stationary, and/or may be temporarily or permanently installed at the wellsite surface 102.

The pumping system 100 may further comprise a second mixer 124 fluidly connected with the first mixer 108 and a second container 126. The second container 126 may contain a second material that may be substantially different than the first material. For example, the second material may be or comprise a proppant material, such as sand, sand-like particles, silica, quartz, and/or propping agents, among other examples. The second mixer 124 may be operable to receive the base fluid from the first mixer 108 via one or more fluid conduits 118, and the second material from the second container 126 via one or more fluid conduits 128, and mix or otherwise combine the base fluid and the second material to form a mixture. The mixture may be or comprise that which is known in the art as a fracturing fluid. The second mixer 124 may then discharge the mixture via one or more fluid conduits 130.

The second mixer 124 and the second container 126 may each be disposed on corresponding trucks, trailers, and/or other mobile carriers 132, 134, respectively, such as may permit their transportation to the wellsite surface 102. However, the second mixer 124 and/or second container 126 may be skidded or otherwise stationary, and/or may be temporarily or permanently installed at the wellsite surface 102.

The mixture may be communicated from the second mixer 124 to a common manifold 136, via the one or more fluid conduits 130. The common manifold 136 may comprise a plurality of valves and diverters, as well as a suction line 138 and a discharge line 140, such as may be operable to direct flow of the mixture in a selected or predetermined manner. The common manifold 136, which may be known in the art as a missile or a missile trailer, may distribute the mixture to a pump fleet, which may comprise a plurality of pump assemblies 200, which may each comprise a pump 202, a prime mover 204, and perhaps a heat exchanger 206. Each pump assembly 200 may receive the mixture from the suction line 138 of the common manifold 136, via one or more fluid conduits 142, and discharge the mixture under pressure to the discharge line 140 of the common manifold 136, via one or more fluid conduits 144. The mixture may then be discharged from the common manifold 136 into the wellbore 104, via one or more fluid conduits 146, perhaps through various valves, conduits, and/or other hydraulic circuitry fluidly connected between the common manifold 136 and the wellbore 104. Each pump 202 of the plurality of pump assemblies 200 may be fluidly connected with the other pumps 202 via the plurality of fluid conduits 144 and the discharge line 140 of the common manifold 136. Each pump 202 of the plurality of pump assemblies 200 may also be fluidly connected with the other pumps 202 via the plurality of fluid conduits 142 and the suction line 138 of the common manifold 136.

The pump assemblies 200 may each be mounted on corresponding trucks, trailers, and/or other mobile carriers 148, such as may permit their transportation to the wellsite surface 102. However, the pump assemblies 200 may be skidded or otherwise stationary, and/or may be temporarily or permanently installed at the wellsite surface 102.

The pump assemblies 200 shown in FIG. 1 may comprise pumps 202 having a substantially same or similar structure and/or function, although other implementations within the scope of the present disclosure may include different types and/or sizes of pumps 202. Although the pump fleet of the pumping system 100 is shown comprising six pump assemblies 200, each disposed on the corresponding mobile carrier 148, pump fleets comprising other quantities of pump assemblies 200 are also within the scope of the present disclosure.

The pumping system 100 may also comprise a control center 150, such as may be operable to provide control to one or more portions of the pumping system 100. Control signals may be communicated between the control center 150 and other wellsite equipment via corresponding cables (not shown). However, other means of signal communication, such as wireless communication, are also within the scope of the present disclosure.

The control center 150 may be operable to control power distribution between a source of electric power (not shown) and the first mixer 108, the second mixer 124, the pump assemblies 200, and/or other pumps, material transporters (e.g., conveyers), and/or other wellsite equipment (not shown). The control center 150 may be employed to monitor and control one or more components, sub-systems, systems, and/or other portions of the pumping system 100 during pumping operations. For example, the control center 150 may be operable to monitor and/or control the production rate of mixtures formed at the wellsite, such as by increasing or decreasing the flow of the liquid from the tanks 110, the first material from the first container 112, the base fluid from the first mixer 108, the second material from the second container 126, and/or the mixture from the second mixer 124. The control center 150 may also be operable to monitor and/or control operational parameters of each pump assembly 200, such as operating frequency or speed, phase or angular (i.e., rotational) position, vibration, pressure, flow rates, and temperature. The control center 150 may also be operable to monitor health and/or functionality of the pump assemblies 200.

The control center 150 may be disposed on a corresponding truck, trailer, and/or other mobile carrier 152, such as may permit its transportation to the wellsite surface 102. However, the control center 150 may be skidded or otherwise stationary, and/or may be temporarily or permanently installed at the wellsite surface 102.

FIG. 1 depicts the pumping system 100 as being operable to produce and/or mix fluids and/or mixtures (hereinafter collectively referred to as a "fluid") that may be pressurized and individually or collectively injected into the wellbore 104 during hydraulic fracturing of the subterranean formation 106. However, it is to be understood that the pumping system 100 may be operable to mix and/or produce other fluids that may be pressurized and individually or collectively injected into the wellbore 104 during other oilfield operations, such as drilling, cementing, acidizing, chemical injecting, and/or water jet cutting operations, among other examples.

Figure 2:
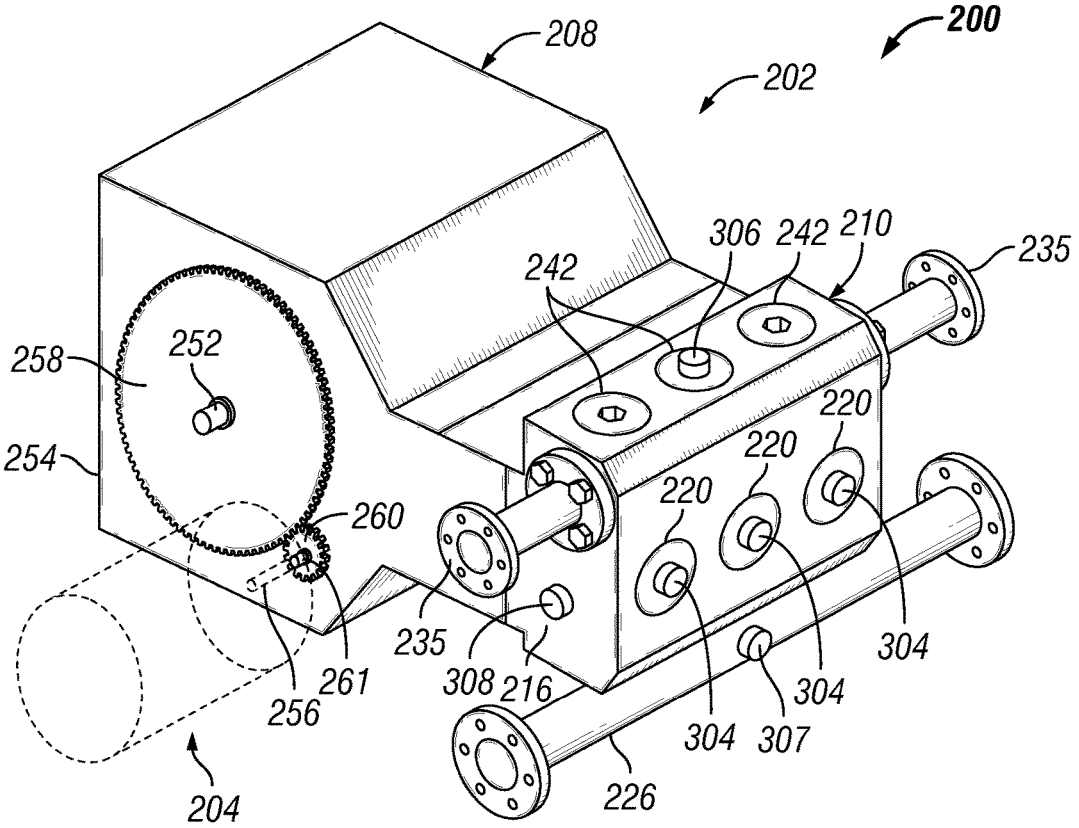
FIG. 2 is a perspective view of a portion of an example implementation of the apparatus shown in FIG. 1 according to one or more aspects of the present disclosure.
Figure 3:
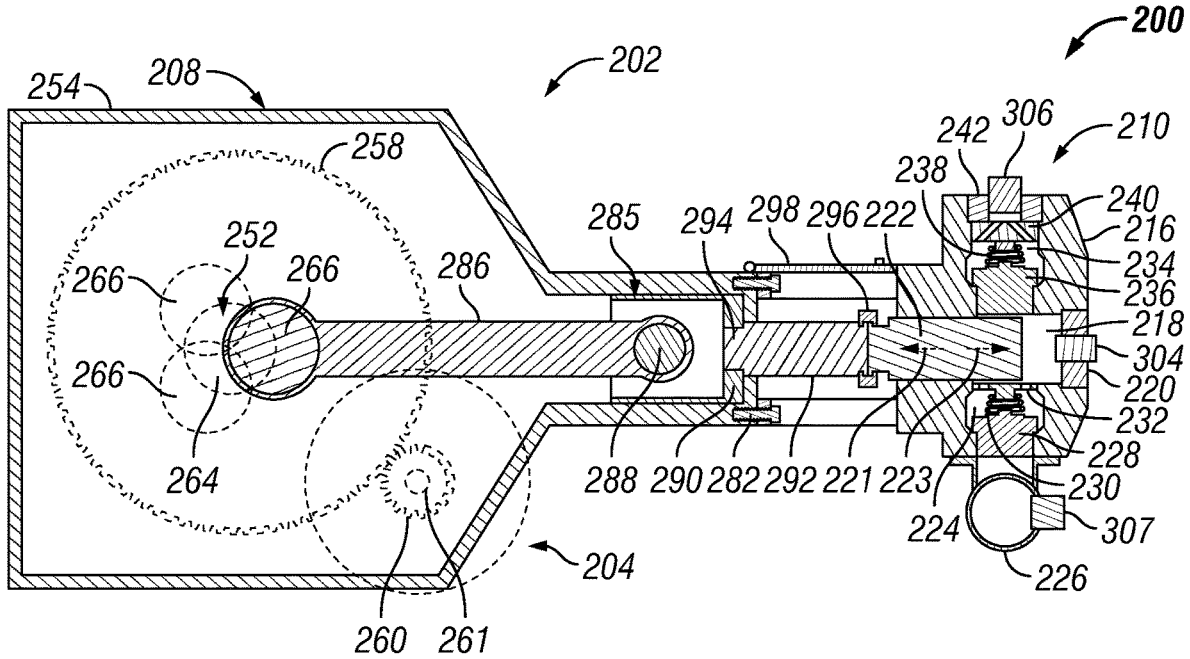
FIG. 3 is a side sectional view of an example implementation of the apparatus shown in FIG. 2 according to one or more aspects of the present disclosure.

FIG. 2 is a perspective view of a portion of an example implementation of an instance of the pump assemblies 200 shown in FIG. 1 according to one or more aspects of the present disclosure. FIG. 3 is a side sectional view of a portion of the pump assembly 200 shown in FIG. 2. The following description refers to FIGS. 1-3, collectively.

The pump assembly 200 comprises a fixed-displacement, reciprocating pump 202 operatively coupled with the prime mover 204. The pump 202 comprises a power section 208 and a fluid section 210. The fluid section 210 comprises a pump housing 216 having a plurality of fluid chambers 218. One end of each fluid chamber 218 may be plugged by a cover plate 220, such as may be threadedly engaged with the pump housing 216. The opposite end of each fluid chamber 218 contains a reciprocating fluid displacing member 222 slidably disposed therein and operable to displace the fluid within the corresponding fluid chamber 218. Although the fluid displacing member 222 is depicted as a plunger, the fluid displacing member 222 may also be implemented as a piston, diaphragm, or another type of reciprocating fluid displacing member.

Each fluid chamber 218 is fluidly connected with a corresponding one of a plurality of fluid inlet cavities 224 each adapted for communicating fluid from a fluid inlet conduit 226 into a corresponding fluid chamber 218. The fluid inlet conduit 226 may be or comprise at least a portion of the one or more fluid conduits 142 and/or may otherwise be in fluid communication with the suction line 138 of the common manifold 136.

Associated with each fluid inlet cavity 224 is an inlet valve 228 operable to control fluid flow from the fluid inlet conduit 226 into the fluid chamber 218. Each inlet valve 228 may be biased toward a closed position by a spring 230, which may be held in place by an inlet valve stop 232. Each inlet valve 228 may be actuated to an open position by a selected or predetermined differential pressure between the corresponding fluid inlet cavity 224 and the fluid inlet conduit 226.

Each fluid chamber 218 is also fluidly connected with a fluid outlet cavity 234 extending through the pump housing 216 transverse to the fluid displacing members 222. The fluid outlet cavity 234 is adapted for communicating pressurized fluid from each fluid chamber 218 into one or more fluid outlet conduits 235. Each fluid outlet conduit 235 may be or comprise at least a portion of the one or more fluid conduits 144 and/or may otherwise be in fluid communication with the discharge line 140 of the common manifold 136, such as may facilitate injection of the fluid into the wellbore 104 during oilfield operations.

The fluid section 210 also includes outlet valves 236 each operable to control fluid flow from a corresponding fluid chamber 218 into the fluid outlet cavity 234. Each outlet valve 236 may be biased toward a closed position by a spring 238, which may be held in place by an outlet valve stop 240. Each outlet valve 236 may be actuated to an open position by a selected or predetermined differential pressure between the corresponding fluid chamber 218 and the fluid outlet cavity 234. The fluid outlet cavity 234 may be plugged by one or more cover plates 242, such as may be threadedly engaged with the pump housing 216, and one or both ends of the fluid outlet cavity 234 may be fluidly coupled with the one or more fluid outlet conduits 235.

During pumping operations, portions of the power section 208 rotate in a manner that generates a reciprocating linear motion to move the fluid displacing members 222 longitudinally within the corresponding fluid chambers 218, thereby alternatingly drawing and displacing the fluid within the fluid chambers 218. With regard to each fluid displacing member 222, as the fluid displacing member 222 moves out of the fluid chamber 218, as indicated by arrow 221, the pressure of the fluid inside the corresponding fluid chamber 218 decreases, thus creating a differential pressure across the corresponding fluid inlet valve 228. The pressure differential operates to compress the spring 230, thus actuating the fluid inlet valve 228 to an open position to permit the fluid from the fluid inlet conduit 226 to enter the corresponding fluid inlet cavity 224. The fluid then enters the fluid chamber 218 as the fluid displacing member 222 continues to move longitudinally out of the fluid chamber 218, until the pressure difference between the fluid inside the fluid chamber 218 and the fluid within the fluid inlet conduit 226 is low enough to permit the spring 230 to actuate the fluid inlet valve 228 to the closed position.

As the fluid displacing member 222 begins to move longitudinally back into the fluid chamber 218, as indicated by arrow 223, the pressure of the fluid inside of fluid chamber 218 begins to increase. The fluid pressure inside the fluid chamber 218 continues to increase as the fluid displacing member 222 continues to move into the fluid chamber 218, until the pressure of the fluid inside the fluid chamber 218 is high enough to overcome the pressure of the fluid inside the fluid outlet cavity 234 and compress the spring 238, thus actuating the fluid outlet valve 236 to the open position and permitting the pressurized fluid to move into the fluid outlet cavity 234 and the fluid outlet conduit 235. Thereafter, the fluid may be communicated to the common manifold 136 and the wellbore 104 or to another destination.

The fluid flow rate generated by the pump assembly 200 may depend on the physical size of the fluid displacing members 222 and fluid chambers 218, as well as the pump operating speed, which may be defined by the speed or rate at which the fluid displacing members 222 cycle or move within the fluid chambers 218. The speed or rate at which the fluid displacing members 222 move may be related to the rotational speed of the power section 208. Accordingly, the fluid flow rate may be controlled by the rotational speed of the power section 208.

The prime mover 204 may be operatively coupled with a drive shaft 252 enclosed and maintained in position by a power section housing 254, such that the prime mover 204 is operable to drive or otherwise rotate the drive shaft 252. The prime mover 204 may comprise a rotatable output shaft 256 operatively connected with the drive shaft 252 by a transmission or gear train, such as may comprise a spur gear 258 coupled with the drive shaft 252 and a pinion gear 260 coupled with a support shaft 261. The output shaft 256 and the support shaft 261 may be coupled in a manner facilitating transfer of torque from the prime mover 204 to the support shaft 261, the pinion gear 260, the spur gear 258, and the drive shaft 252. To prevent relative rotation between the power section housing 254 and the prime mover 204, the power section housing 254 and prime mover 204 may be fixedly coupled together or to a common base, such as a trailer of the mobile carrier 148. The prime mover 204 may comprise a gasoline, diesel, or other engine, a synchronous or asynchronous electric motor (such as a synchronous permanent magnet motor), a hydraulic motor, or another prime mover operable to rotate the drive shaft 252.

Figure 4:
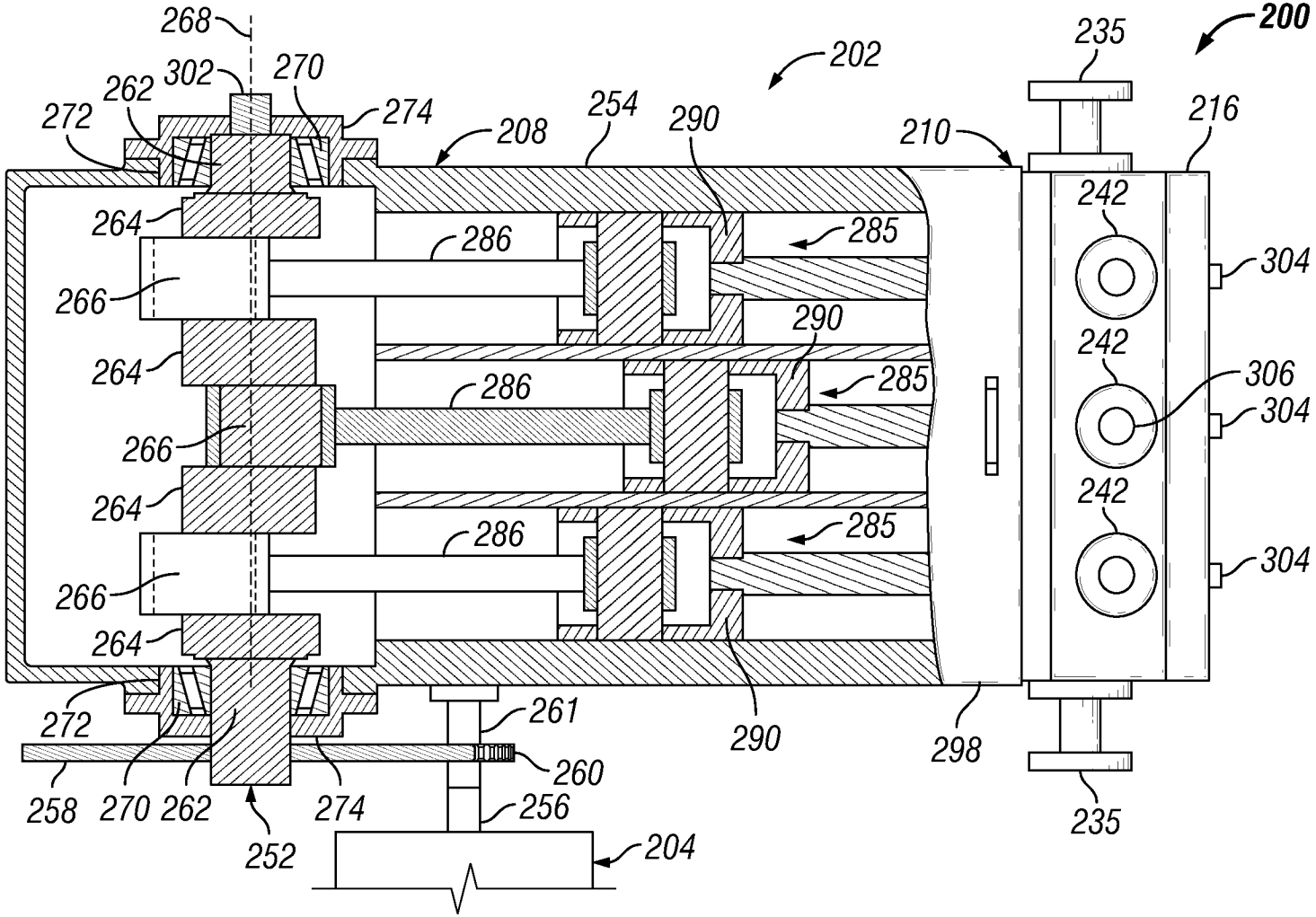
FIG. 4 is a top partial sectional view of an example implementation of the apparatus shown in FIG. 2 according to one or more aspects of the present disclosure.

FIG. 4 is a top partial sectional view of a portion of an example implementation of the pump assembly 200 shown in FIGS. 2 and 3 according to one or more aspects of the present disclosure. Referring to FIGS. 3 and 4, collectively, the drive shaft 252 may be implemented as a crankshaft comprising a plurality of support journals 262, main journals 264, and crankpin journals 266. The support and main journals 262, 264 may extend along a central axis of rotation 268 of the drive shaft 252, while the crankpin journals 266 may be offset from the central axis of rotation 268 by a selected or predetermined distance and spaced 120 degrees apart with respect to the support journals 262 and main journals 264. The drive shaft 252 may be supported in position within the power section 208 by the power section housing 254, and the support journals 262 may extend through opposing openings 272 in the power section housing 254. To facilitate rotation of the drive shaft 252 within the power section housing 254, one or more bearings 270 may be disposed about the support journals 262 and against the side surfaces of the openings 272. A cover plate and/or other means for protection 274 may enclose the bearings 270.

The power section 208 and the fluid section 210 may be coupled or otherwise connected together. For example, the pump housing 216 may be fastened with the power section housing 254 by threaded fasteners 282. The pump assembly 200 may further comprise an access door 298 permitting access to portions of the pump 202 located between the power section 208 and the fluid section 210, such as may be utilized during assembly and/or maintenance of the pump 202.

Crosshead mechanisms 285 may be utilized to transform and transmit the rotational motion of the drive shaft 252 to a reciprocating linear motion of the fluid displacing members 222. For example, each crosshead mechanism 285 may comprise a connecting rod 286 pivotally coupled with a corresponding crankpin journal 266 at one end, and with a pin 288 of a crosshead 290 at an opposing end. During pumping operations, walls and/or interior portions of the power section housing 254 may guide each crosshead 290, such as may reduce or eliminate lateral motion of each crosshead 290. Each crosshead mechanism 285 may further comprise a piston rod 292 coupling the crosshead 290 with the fluid displacing member 222. The piston rod 292 may be coupled with the crosshead 290 via a threaded connection 294, and with the fluid displacing member 222 via a flexible connection 296.

Although FIGS. 2-4 depict the pump assembly 200 as comprising a triplex reciprocating pump 202 comprising three fluid chambers 218 and three fluid displacing members 222, other implementations within the scope of the present disclosure may include the pump 202 implemented as or comprising a quintuplex reciprocating pump comprising five fluid chambers 218 and five fluid displacing members 222, or other quantities of fluid chambers 218 and fluid displacing members 222. It is further noted that the pump 202 described above and shown in FIGS. 2-4 is an exemplary pump 202, and that diaphragm pumps, gear pumps, external circumferential pumps, internal circumferential pumps, lobe pumps, centrifugal pumps, and/or other types of pump equipment may also be monitored for health and/or functionality according to one or more aspects of the present disclosure.

Regardless of the type of pump or prime mover utilized, regular pump assembly monitoring and maintenance may aid in ensuring uptime and increasing efficiency of operations. Like other forms of industrial equipment, pump assemblies are susceptible to defects or unhealthy conditions that may affect uptime or efficiency. Such defects may result in substantial losses in the case of pump assemblies utilized in large-scale oilfield operations because, for example, the pump assemblies may be employed at the oilfield wellsite on a round-the-clock basis.

Defects in pump assembly components may present in a variety of forms, including those that cause unhealthy conditions of the pump 202 and/or other components of the pump assembly 200. Such defects and/or unhealthy conditions may include: improperly primed fluid chambers 218; damaged, worn, leaking, failing, or failed seals of the inlet and/or outlet valves 228, 236; and damaged, worn, leaking, failing, or failed fluid displacing members 222. These and other defects may be the result of abrasive fluids directed through the pump assembly 200 during operations, among other example causes, and may cause pressure changes and/or flow fluctuations in one or more portions of the pump assembly 200. Other example defects of the pump assembly 200 include damage to one or more rotating, oscillating, or otherwise repetitively moving components of the pump assembly 200, which may introduce vibrations or cause vibration changes in the pump assembly 200. For example, chipping, cracking, breaking, wear, and/or erosion of a component of the pump assembly 200 may alter an existing vibration signature or cause a new vibration signature. Other example defects include loosened mounts of the prime mover 204, deteriorated bearings 270 of the crankshaft 252, and transmission defects such as a slipping clutch or a broken tooth of one of the gears 258, 260. Thus, as indicated above, regular monitoring and maintenance of pumping equipment health, including physical condition, presence of defects, level or degree of defects, remaining functional life, and/or combinations of these factors and/or others, may be a part of ongoing pumping operations.

Defects of the pump assembly 200, including the examples described above and/or others, may generate, change, and/or be accompanied by operational parameters associated with the pump assembly 200 during pumping operations. Such operational parameters may include vibrations, flow fluctuations, and pressure fluctuations, among other examples, and may be particular to a type of defect that is present or developing in one or more components of the pump assembly 200. Therefore, such operational parameters may be monitored during operations to monitor the health of the corresponding component(s). Accordingly, the pumping system 100 (FIG. 1) may further comprise a monitoring and control system 300 (hereinafter referred to as a "control system") operable to monitor and/or control certain operating parameters of the pump assemblies 200 or portions of the pump assemblies 200, such as the pump 202, the transmission, and/or the prime mover 204. The control system 300 may also be operable to monitor and/or control certain operating parameters of the pumping system 100 or portions of the pumping system 100.

Figure 5:
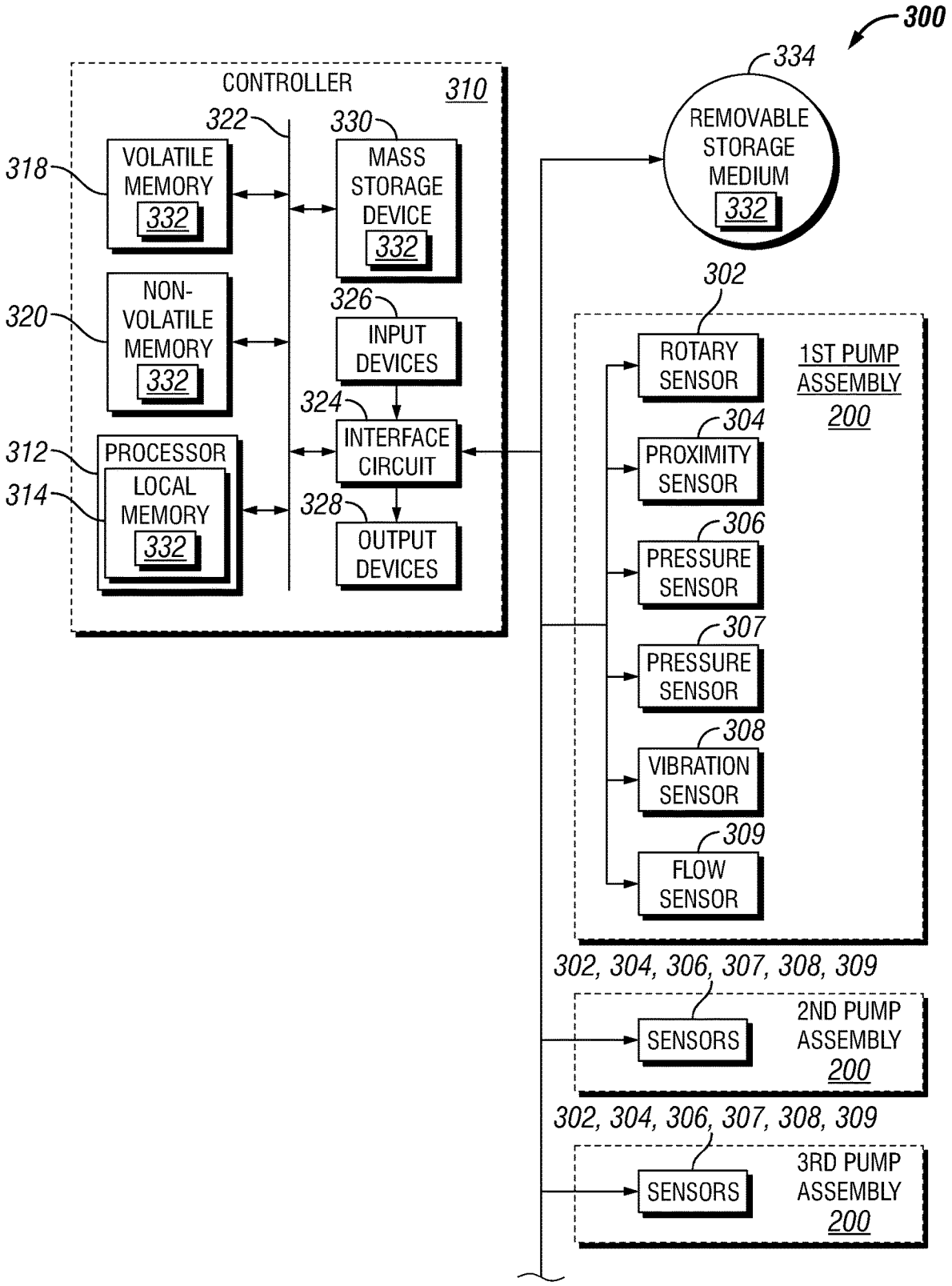
FIG. 5 is a schematic view of at least a portion of an apparatus according to one or more aspects of the present disclosure.

FIG. 5 is a schematic view of a portion of an example implementation of the control system 300 according to one or more aspects of the present disclosure. The following description refers to FIGS. 1-5, collectively.

The control system 300 may monitor the operating parameters associated with one or more pump assemblies 200 via a number of parameter sensors. The parameter sensors may generate signals or information related to acoustics, vibrations, and/or fluctuations in fluid flow, fluid pressure, fluid temperature, fluid level, component temperature, component weight, operational torque, electrical load, mechanical load, and/or other operational parameters (hereinafter collectively referred to as "parameter data") associated with one or more components of the pump assemblies 200.

The parameter sensors may comprise pressure sensors 306 each associated with a corresponding pump 202 and operable to convert fluid pressure fluctuations at the fluid outlet of the pump 202 to electrical signals and/or other information related to or indicative of such fluid pressure fluctuations. Each pressure sensor 306 may extend through a cover plate 242 or other portion of the pump housing 216 into the fluid outlet cavity 234, or otherwise be disposed in association with the fluid outlet in a manner permitting the sensing of pressure fluctuations at the pump outlet. For example, each pressure sensor 306 may be operable to sense pressure ranging between about zero PSI and about 20,000 PSI, including fluctuations within such pressure range.

The parameter sensors may also or instead comprise pressure sensors 307 each associated with a corresponding pump 202 and operable to convert fluid pressure fluctuations at the fluid inlet of the pump 202 to electrical signals and/or other information related to or indicative of such fluid pressure fluctuations. Each pressure sensor 307 may extend into the fluid inlet conduit 226 or otherwise be disposed in association with the pump inlet in a manner permitting the sensing of pressure fluctuations at the pump inlet. For example, each pressure sensor 307 may be operable to sense pressure ranging between about zero PSI and about 1,000 PSI, including fluctuations within such pressure range.

The parameter sensors may also or instead comprise vibration sensors 308 each associated with a corresponding pump assembly 200 and operable to convert low and high frequency vibrations or acoustics to electrical signals and/or other information related to or indicative of the amplitude and/or frequency of vibrations or acoustics. For example, each vibration sensor 308 may be or comprise an accelerometer and/or other device operable to detect vibrations particular to a certain type of defect, such as a leak or incomplete seal within the fluid chamber 218 of the pump 202, a loose component of the pump assembly 200, a broken component of the pump assembly 200, and/or other types of defects that may be precursors to pump failure. Each vibration sensor 308 may be connected with the pump housing 216, the power section housing 254, the prime mover 204 housing, and/or another portion of the pump assembly 200 in a manner permitting the sensing of the vibrations or acoustics.

The parameter sensors may also or instead comprise flow sensors 309 each associated with a corresponding pump assembly 200 and operable to generate electrical signals and/or other information related to or indicative of the fluid flow rate of the pump assembly. Each flow sensor 309 may be connected along the one or more fluid conduits 144 extending between the fluid outlet conduits 235 of the pumps 202 and the discharge line 140 of the common manifold 136, or along the one or more fluid conduits 142 extending between the fluid inlet conduits 226 of the pumps 202 and the suction line 138 of the common manifold 136, and/or otherwise disposed in association with the pump assembly 200 in a manner permitting the sensing of fluid flow fluctuations generated by the corresponding pump 202.

As depicted in the example implementation shown in FIG. 1, oilfield operations may employ multiple pumps 202 and associated equipment that may be operated simultaneously, and such pumps 202 may be in fluid communication with one another through the common manifold 136. Therefore, detection of a given defect in one of the pump assemblies 200 may not be indicative of the particular pump assembly 200 comprising the defect. To distinguish the source of signal or information associated with the unhealthy pump assembly 200 relative to the other pump assemblies 200, the phase, rotational position, and/or angular position (hereinafter collectively referred to as "angular position") associated with operation of a particular one of the pump assemblies 200 may be monitored or tracked to characterize the signal or information associated with that pump assembly 200. Such angular position may include angular position of the prime mover 204, angular position of one or more gears of the transmission, angular position of the driveshaft 250, and/or phase associated with the motion of the fluid displacing members 222. Accordingly, the control system 300 may also monitor the angular position of the pump assemblies 200 via position sensors operable to generate signals or information related to the angular position (hereinafter collectively referred to as "angular position data") of the pump assemblies 200.

The position sensors may comprise one or more rotary sensors 302 each associated with a corresponding pump assembly 200 and operable to generate electrical signals and/or other information related to or indicative of angular position associated with operation of the pump assembly 200, as well as rotational speed and/or operating frequency associated with operation of the pump assembly 200. For example, each rotary sensor 302 may be operable to convert angular position of the drive shaft 252 or another rotating component of the pump assembly 200 to electrical signals and/or other information related to or indicative of the angular position and/or speed associated with operation of the pump assembly 200. Each rotary sensor 302 may be connected to or disposed adjacent an external portion of the drive shaft 252, such as the support journals 262 or other rotating members of the power section 208, and may be supported by the power section housing 254, the cover plate 274, or another portion of the power section 208. Each rotary sensor 302 may be or comprise an encoder, a rotary potentiometer, a synchro, a resolver, and/or a rotary variable differential transformer (RVDT), among other examples.

The position sensors may also or instead comprise one or more proximity sensors 304 each associated with a corresponding pump assembly 200 and operable to convert position or presence (at a certain position) of the fluid displacing members 222 or other rotating or otherwise moving component of the pump assembly 200 to electrical signals and/or other information related to or indicative of the position and/or speed of the moving component. Each proximity sensor 304 may be disposed adjacent a fluid displacing member 222 or otherwise disposed in association with the fluid displacing member 222 in a manner permitting sensing of the position or presence of the fluid displacing member 222 during pumping operations. For example, at least one of the proximity sensors 304 may extend through the cover plate 220 or another portion of the pump housing 216 into a corresponding fluid chamber 218 in a manner permitting the detection of the presence of the corresponding fluid displacing member 222 at a selected or predetermined position. The angular position associated with the operation of the pump assembly 200 may be determined by measuring one position, such as top dead center or bottom dead center of the fluid displacing member 222, and estimating the angular position utilizing information pertaining to the timing of the fluid inlet and/or outlet valves 228, 236. One or more of the proximity sensors 304 may also or instead be disposed adjacent the crosshead mechanisms 285 or the crankshafts 252 in a manner permitting the detection of the presence and/or movement of a portion of the crosshead mechanism 285 or the crankshaft 252 and, therefore, the angular position and/or speed associated with operation of the corresponding pumping assembly 200 during pumping operations. Each proximity sensor 304 may be or comprise a linear encoder, a capacitive sensor, an inductive sensor, a magnetic sensor, a Hall effect sensor, and/or a reed switch, among other examples.

The control system 300 may also comprise a monitoring and control device 310 (hereinafter referred to as a "controller") in communication with the parameter and position sensors 302, 304, 306, 307, 308, 309 and/or otherwise able to receive the electrical output signals and/or other information generated by the parameter and position sensors 302, 304, 306, 307, 308, 309. For example, electrical output signals generated by the parameter and position sensors 302, 304, 306, 307, 308, 309 may range between about four milliamps (mA) and about twenty mA and/or between about zero volts DC and about ten volts DC.

The controller 310 may be further operable to execute example machine-readable instructions to implement at least a portion of one or more of the methods and/or processes described herein, and/or to implement a portion of one or more of the example systems described herein. The controller 310 may be or comprise, for example, one or more processors, special-purpose computing devices, servers, personal computers, personal digital assistant (PDA) devices, smartphones, internet appliances, and/or other types of computing devices. The controller 310 may be implemented as part of the control center 150.

The controller 310 may comprise a processor 312, such as a general-purpose programmable processor. The processor 312 may comprise a local memory 314, and may execute coded instructions 332 present in the local memory 314 and/or another memory device. The processor 312 may execute, among other things, machine-readable instructions or programs to implement the methods and/or processes described herein. The programs stored in the local memory 314 may include program instructions or computer program code that, when executed by an associated processor, facilitate the control system 300, the prime movers 204, the sensors 302, 304, 306, 307, 308, 309, and/or other components to perform at least a portion of one or more of the methods and/or processes described herein. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 312 may be in communication with a main memory, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320. The controller 310 may be operable to store or record the signals or other information generated by the sensors 302, 304, 306, 307, 308, 309 on the main memory.

The controller 310 may also comprise an interface circuit 324. The interface circuit 324 may be, comprise, or be implemented by various types of standard interfaces, such as an Ethernet interface, a universal serial bus (USB), a third generation input/output (3GIO) interface, a wireless interface, and/or a cellular interface, among others. The interface circuit 324 may also comprise a graphics driver card. The interface circuit 324 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). The plurality of sensors 302, 304, 306, 307, 308, 309 may be connected with the controller 310 via the interface circuit 324, such as may facilitate communication between the sensors 302, 304, 306, 307, 308, 309 and the controller 310.

One or more input devices 326 may also be connected to the interface circuit 324. The input devices 326 may permit a human operator to enter data and commands into the processor 312, such as the selected or predetermined angular position, speed, flow, and/or pressure parameters described herein. The input devices 326 may be, comprise, or be implemented by a keyboard, a mouse, a touchscreen, a track-pad, a trackball, an isopoint, and/or a voice recognition system, among other examples. One or more output devices 328 may also be connected to the interface circuit 324. The output devices 328 may be, comprise, or be implemented by display devices (e.g., a liquid crystal display (LCD) or cathode ray tube display (CRT), among others), printers, and/or speakers, among other examples.

The controller 310 may also comprise one or more mass storage devices 330 for storing machine-readable instructions and data. Examples of such mass storage devices 330 include floppy disk drives, hard drive disks, compact disk (CD) drives, and digital versatile disk (DVD) drives, among others. The coded instructions 332 may be stored in the mass storage device 330, the volatile memory 318, the non-volatile memory 320, the local memory 314, and/or on a removable storage medium 334, such as a CD or DVD. Thus, the modules and/or other components of the controller 310 may be implemented in accordance with hardware (embodied in one or more chips including an integrated circuit, such as an application specific integrated circuit), or may be implemented as software or firmware for execution by a processor. In the case of firmware or software, the embodiment may be provided as a computer program product including a computer readable medium or storage structure embodying computer program code (i.e., software or firmware) thereon for execution by the processor 312.

During operations of the pumping system 100, the pump assemblies 200 may vibrate due to reciprocating, rotating, or otherwise periodic movement of certain components of the pump assemblies 200. The pumps 202 may also discharge pressurized fluid in an oscillating manner, such as may be caused by the oscillating movement of the fluid displacing members 222. The discharged fluid may thus exhibit cyclical or periodic pressure and/or flow fluctuations at the inlet and/or outlet of each pump 202. As described above, these vibrations, oscillations, and/or pressure/flow fluctuations may change or be caused by the occurrence and/or degree of certain defects in the pump assembly 200. Thus, the defects may be detected by examining the parameter data in an angle domain, a frequency domain, and/or a quefrency domain.

Figure 6:
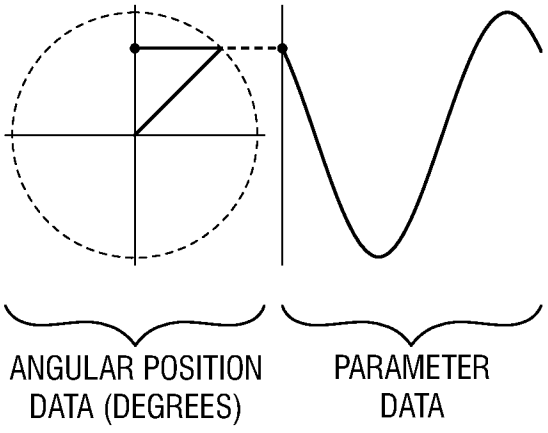
FIGS. 6-15 are graphs related to one or more aspects of the present disclosure.
Figure 7:
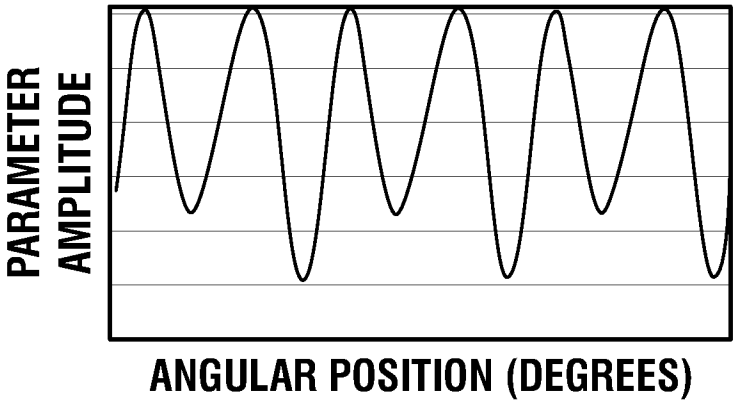

Accordingly, the coded instructions 332 may include program instructions or computer program code that, when executed by the processor 312, cause the controller 310 to perform methods and processes as described herein, including to receive, process, and/or record the parameter data with respect to the angular position data or otherwise associate the parameter data with the position data. FIG. 6 is a graphical representation of the relationship between the parameter data and the angular position data. FIG. 7 is a graph depicting example parameter data plotted with respect to the associated angular position data (i.e., the parameter data in angle domain).

In pumping systems comprising two or more pumps fluidly connected by a manifold and/or other fluid conduits and operating at same or similar frequencies, such as the pumping system 100 shown in FIG. 1, differentiating between healthy and unhealthy pumps has conventionally been problematic. However, based on the position data, the controller 310 may discern the parameter data associated with one pump assembly 200 from parameter data associated with other pump assemblies 200 so as to identify or otherwise determine the pump assembly 200 that is experiencing the defect. The controller 310 may also discern the parameter data that captures or otherwise includes outside noise and/or other data not associated with the pump assembly 200 or component thereof that is defective, such as may be caused by vibrations, pressure fluctuations, and/or flow fluctuations produced by resonant frequencies of the housings 216, 254, fluid conduits 142, 144, 226, 235, and/or other portions of the pump assemblies 200 physically and/or fluidly connected between the unhealthy component (e.g., a broken tooth on the spur gear 258, a leaky fluid outlet valve 236, etc.) and the corresponding one of the parameter sensors 306, 307, 308, 309.

Since the fluid outlet cavities 234 of the pumps 202 are fluidly connected via the fluid conduits 142, 144, 226, 235 and the suction and discharge lines 138, 140 of the common manifold 136, the pressure and/or flow fluctuations generated by or otherwise associated with a defective pump 202 may be detected by each pressure sensor 306, 307 and flow sensor 309 associated with each of the plurality of pumps 202. However, other pump assemblies 200 that are physically and/or fluidly connected with the monitored pump assembly 200 may also cause outside noise. To detect which pump assembly 200 comprises a defect, the angular position data may be utilized to differentiate between a healthy and an unhealthy pump 202. For example, parameter data associated with pressure, flow, and/or vibration changes that occur out of sync with the monitored angular position of the prime mover 204 and/or the pump 202 may comprise interference or outside noise not generated by the monitored pump assembly 200 and may be filtered out by the controller 310. Also, to minimize the transfer of pressure fluctuations between two or more pump assemblies 200, a choke or other pressure control device (not shown) may be connected along the fluid communication lines fluidly connecting the pump assemblies 200, such as fluid conduits 142, 144.

Figure 8:
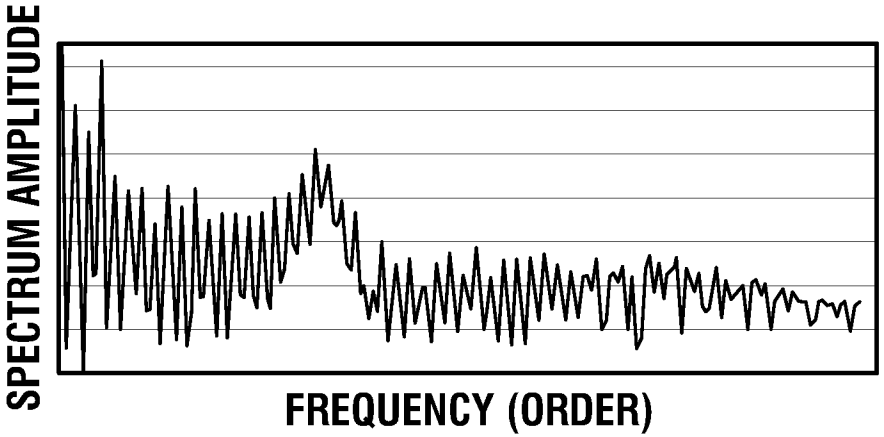

To analyze the parameter data in frequency domain, the controller 310 may be or comprise a spectrum analyzer operable to processes and convert the parameter data with respect to angular position data from the angle domain to the frequency domain, such as to determine or generate an order spectrum of the parameter data. The order spectrum identifies the amplitude of the spectrum of the parameter data with respect to harmonic frequency orders (also known as "harmonics"), which occur at integer multiples of the operating speed or frequency (i.e., fundamental frequencies) of the pump 202, the prime mover 204, the gears 258, 260, the fluid displacing members 222, and other portions of the pump assembly 200 that reciprocate, rotate, or otherwise move periodically. The order spectrum may be determined by transforming the parameter data in angle domain into the frequency domain utilizing one or more mathematical transforms known in the art. Such transforms may include the Fourier transform, the Continuous Fourier transform, the Discrete Fast Fourier transform, the Hilbert transform, the Laplace transform, the Maximum Entropy Method, and the like. The controller 310 may be operable to utilize one or more of the transforms to perform the angle domain to frequency domain conversion described above. FIG. 8 is a graph showing order spectrum of an example parameter data converted from the angle domain to the frequency domain.

To analyze the parameter data in quefrency domain, the controller 310 may be operable to processes and convert the order spectrum from the frequency domain to the quefrency domain, such as to determine or generate an order cepstrum of the parameter data with respect to the angular position data. The order cepstrum separates the harmonic frequencies of the parameter data and identifies periodicity of the harmonic frequencies. Accordingly, the cepstrum may be referred to as a "spectrum of a spectrum." The cepstrum may show rahmonics (i.e., spikes associated with the harmonics of the spectrum) having certain amplitudes and occurring at certain quefrencies, which are indicative of the angle between repeating instances of the parameter data. The repeating instances of the parameter data may include vibrations, pressure fluctuations, and/or flow fluctuations caused by portions or components of the pump assembly 200 that reciprocate, rotate, or otherwise move periodically during pumping operations. The cepstrum may be determined by performing an inverse Fourier Transform of the logarithm of the frequency spectrum of the parameter data with respect to the angular position data, as set forth below in Equation (1).

$$C(\alpha)=F^{-1}\{\log(F\{f(\alpha)\})\} \quad (1)$$

where:

$C(\alpha)$ is the cepstrum of the parameter data with respect to the angular position data;

$F^{-1}$ is an inverse Fourier transform;

F is a Fourier transform; and $f(\alpha)$ is the parameter data with respect to the angular position data.

Figure 9:
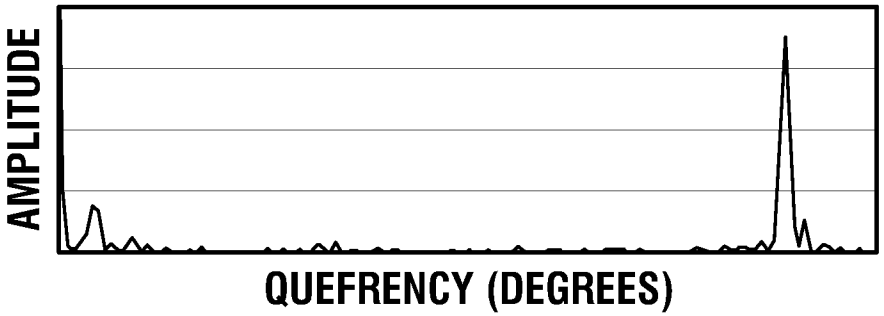

FIG. 9 is a graph depicting the order cepstrum of example parameter data converted from the angle domain to the quefrency domain.

Figure 10:
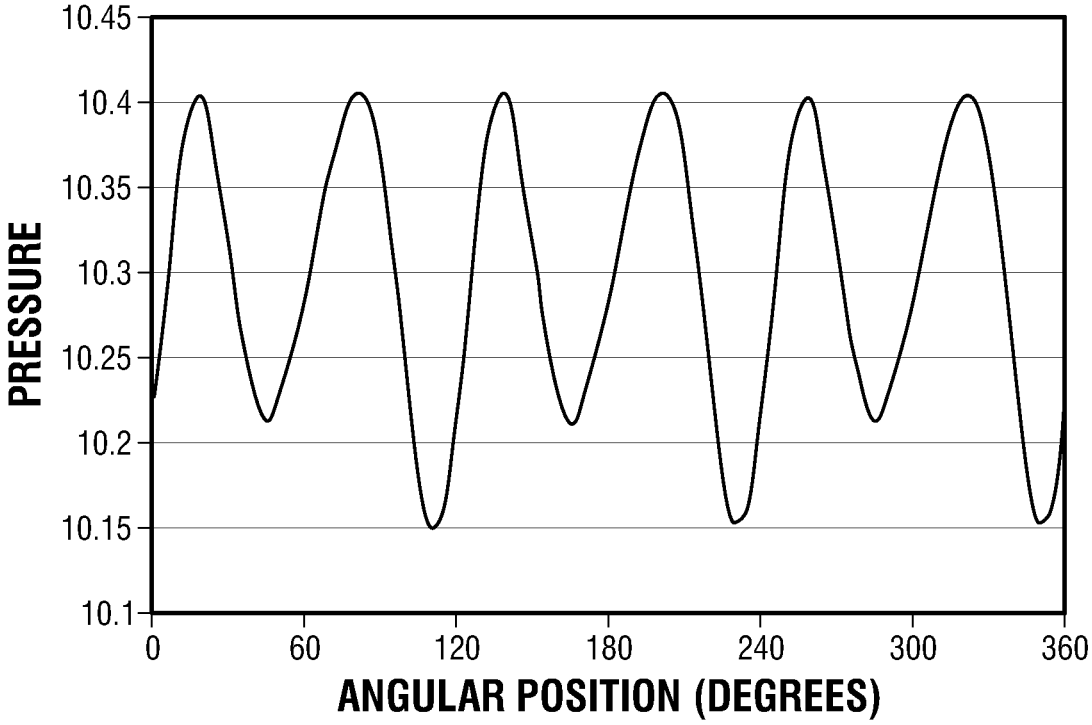

FIG. 10 is a graph depicting example parameter data associated with a pump 202 of the pumping system 100 shown in FIG. 1. The example parameter data is related to pressure fluctuations within the pump 202, as sensed by the pressure sensor 306 disposed at the fluid outlet cavity 234. The parameter data is plotted with respect to angular position (i.e., in angle domain), which was monitored by the rotary sensor 302. The monitored pump 202 is in a healthy condition, and is being operated at a frequency of about 427 revolutions per minute (RPM) and at a pressure of about 3,000 PSI.

Figure 11:
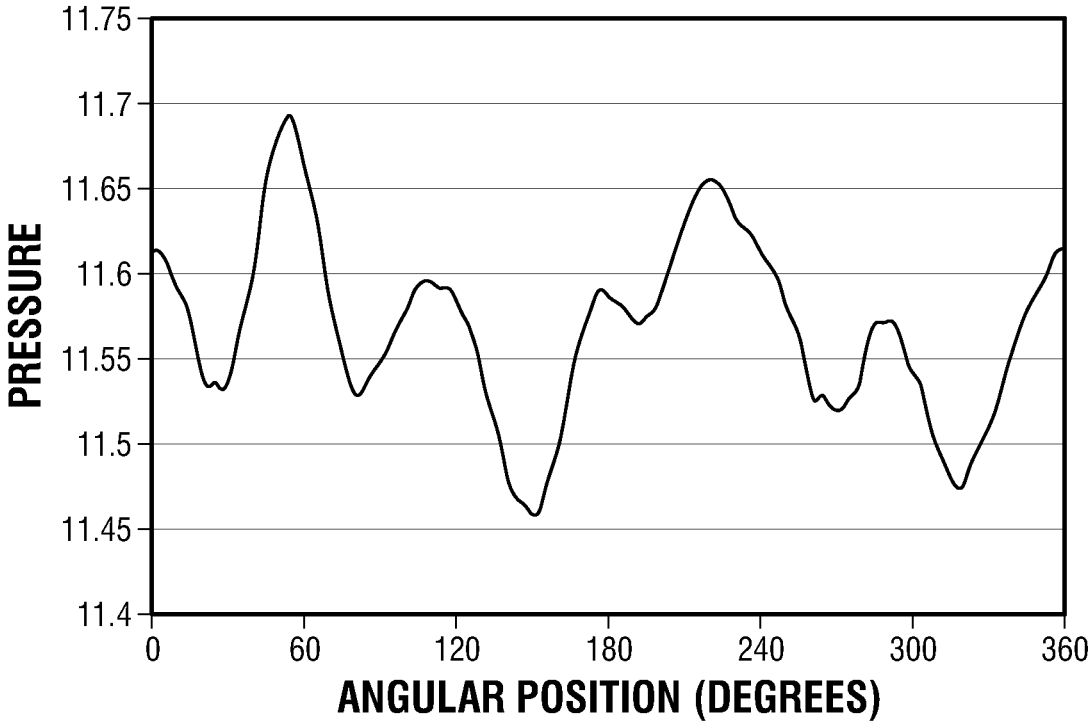

FIG. 11 is a graph depicting further example parameter data generated during pumping operations associated with a pump 202 of the pumping system 100 shown in FIG. 1. The example parameter data is related to pressure fluctuations within an unhealthy pump 202, as sensed by the pressure sensor 306 disposed at the fluid outlet cavity 234. The pump 202 is operating at a frequency of 427 RPM and at a pressure of about 3,000 PSI, plotted with respect to angular position, which was monitored by the rotary sensor 302. Unlike in FIG. 10, the pump 202 in FIG. 11 comprises a defective outlet valve 236, thus preventing the pressure in the fluid outlet cavity 234 from building at the angular position of about 160 degrees. The pump 202 may thus be examined to determine what events are taking place within the pump 202 at the angular position of about 160 degrees (e.g., which fluid displacing member is extending) to identify the defect. Accordingly, information related to pressure fluctuations examined in angle domain may be indicative of the pump defects. The controller 310 may be programmed to substantially automatically detect the presence, amplitude, and/or angular position of defect-indicating or otherwise unintended pressure fluctuations or changes, and to consequently generate information related to the presence and/or degree of unhealthy pump conditions.

Figure 12:
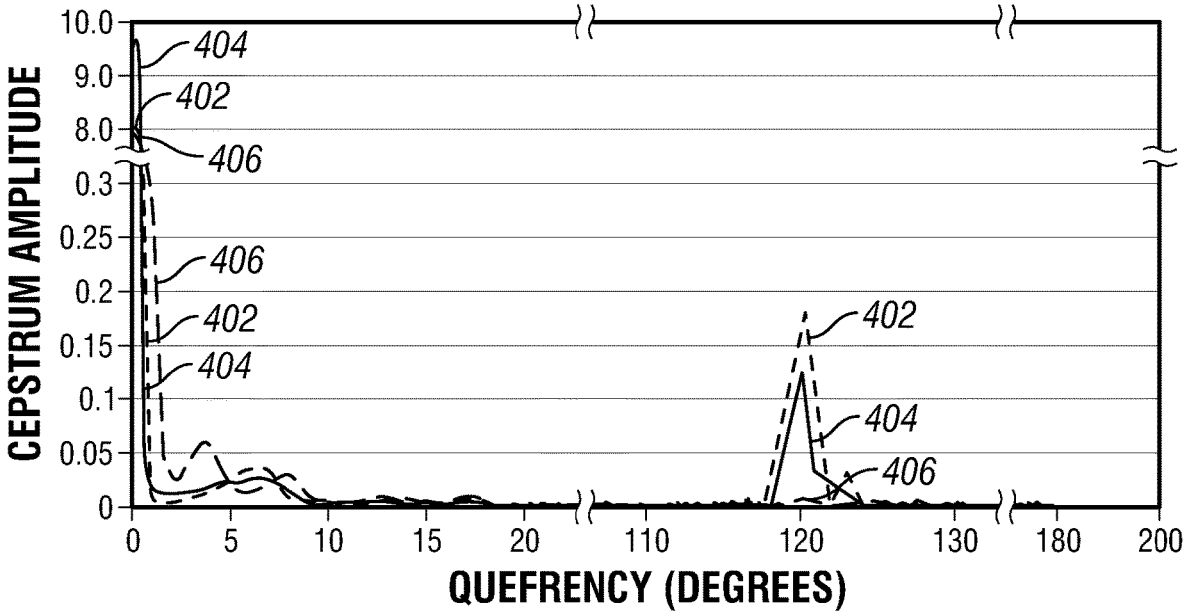

FIG. 12 is a graph depicting example parameter data related to pressure fluctuations transformed into the quefrency domain by the controller 310, as described above. The graph shows the order cepstrum of three parameter data sets, each associated with a triplex positive displacement pump 202 at a different level of health. Each of the three cepstrum profiles or curves 402, 404, 406 was generated based on pressure fluctuation data monitored at the fluid outlet cavity 234 with the pressure sensor 306 with respect to the angular position of the pump assembly 200 monitored by the rotary sensor 302. The first cepstrum curve 402 is associated with the pump 202 in a healthy or otherwise functioning state. The first cepstrum curve 402 is characterized by an amplitude of about 8.04 at a quefrency of about zero degrees, and by a rahmonic having an amplitude of about 0.18 at a quefrency of about 120 degrees, which corresponds to the angle between each pressure fluctuation caused by the three fluid displacing members 222 of the pump 202. The second cepstrum curve 404 is associated with the pump 202 in a partially unhealthy state. The second cepstrum curve 404 is characterized by an amplitude of about 9.72 at a quefrency of about zero degrees, and by a rahmonic having an amplitude of about 0.13 at a quefrency of about 120 degrees. The third cepstrum curve 406 is associated with the pump 202 in an unhealthy state. The third cepstrum curve 406 is characterized by an amplitude of about 7.82 at a quefrency of about zero degrees, and by a rahmonic having an amplitude of about 0.001 at a quefrency of about 120 degrees.

Upon examination, the amplitudes of the cepstrum curves 402, 404, 406 at quefrencies of about zero degrees and about 120 degrees have changed with the decreasing health of the outlet valve 236 of the pump 202. Accordingly, the relationship between the amplitudes of cepstrum curves at quefrency of about zero degrees and the amplitudes of cepstrum curves at a selected non-zero quefrency may permit the health of the pump assembly 200 or selected components of the pump assembly 200 to be monitored by the control system 300. Therefore, the coded instructions 332, when executed, may further cause the controller 310 to determine a ratio of the amplitude of the cepstrum at the quefrency of about zero degrees to the amplitude of the cepstrum at a selected non-zero quefrency, such as to determine or estimate a remaining functional life of the pump assembly 200 or a component of the pump assembly 200. The selected non-zero quefrency may be selected based on the quefrency of a rahmonic associated with a monitored component or portion of the pump assembly 200. Hence, for the cepstrum curve 402, which is associated with a healthy pump assembly 200, the cepstrum amplitude ratio is about 45. For the cepstrum curve 404, which is associated with a partially unhealthy pump assembly 200, the cepstrum amplitude ratio is about 77. For the cepstrum curve 406, which is associated with an unhealthy pump assembly 200, the cepstrum amplitude ratio is about 7821.

The controller 310 may also normalize the determined ratios based on an initial ratio of the cepstrum amplitudes determined during initial operation of the pump assembly 200 at the beginning of the operational life of the pump assembly 200 when the pump 202 is healthy. Thus, continuing with the example above, the normalized cepstrum amplitude ratio associated with the cepstrum curve 402 for the healthy pump assembly 200 is about 1, the normalized cepstrum amplitude ratio associated with the cepstrum curve 404 for the partially unhealthy pump assembly 200 is about 1.7, and the normalized cepstrum amplitude ratio associated with the cepstrum curve 406 for the unhealthy pump assembly 200 is about 173.8. When the normalized cepstrum amplitude ratio is about two or more, the corresponding component of the pump assembly 200 may be at least partially defective. Thus, normalized cepstrum amplitude ratios may be indicative of the health of a component of the pump assembly 200, and may permit custom calibration of health monitoring operations to individual pump assemblies 200.

Figure 13:
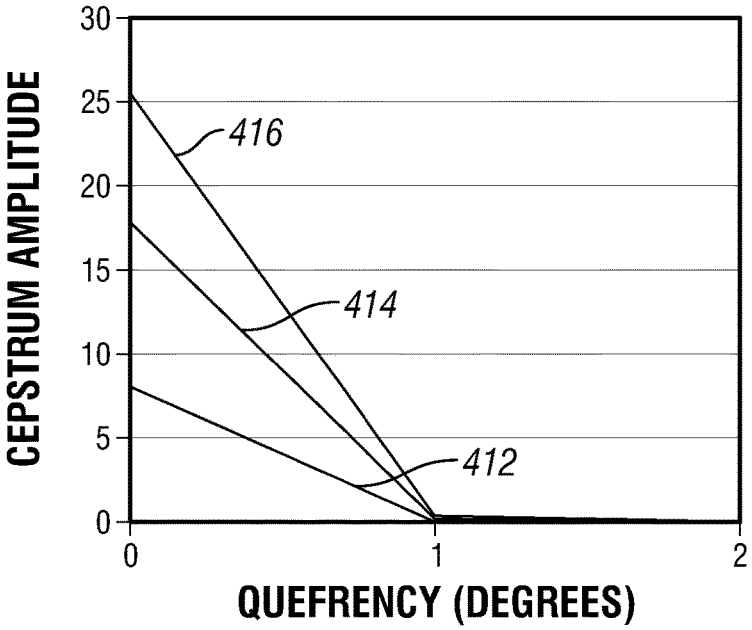
Figure 14:
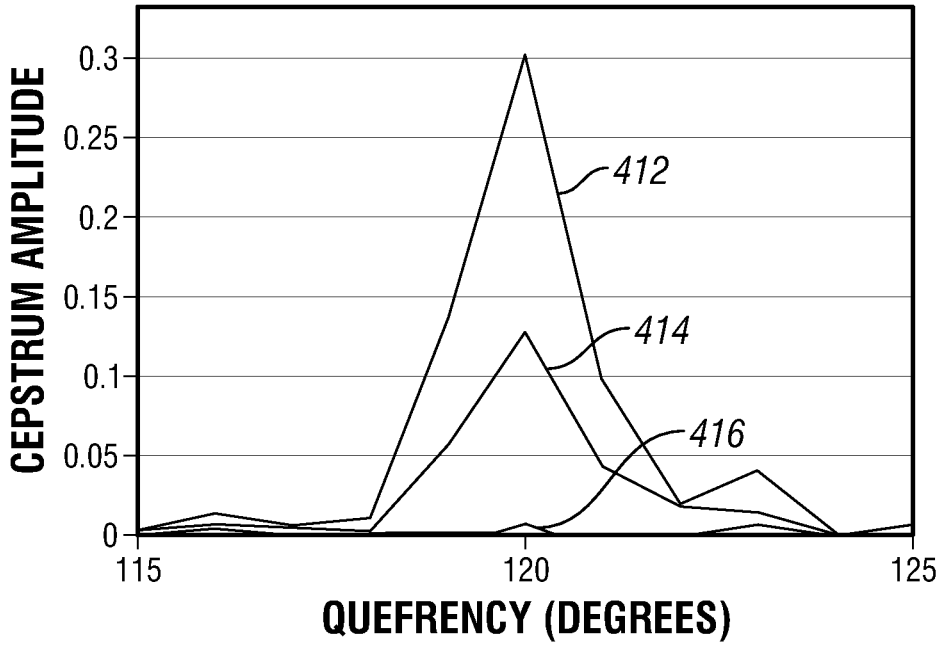

FIGS. 13 and 14 are graphs showing another example of parameter data related to pressure fluctuations transformed into the quefrency domain by the controller 310. The graphs show the order cepstrum of three parameter data sets taken at different levels of health of the triplex positive displacement pump 202 operating at about 3000 PSI and about 275 RPM. Unlike in FIG. 12, the graphs in FIGS. 13 and 14 show cepstrum curves 412, 414, 416 within selected quefrency windows. The cepstrum curves 412, 414, 416 were generated based on pressure fluctuation data monitored at the fluid outlet cavity 234 with the pressure sensor 306 with respect to the angular position associated with the operation of the pump assembly 200 monitored by the rotary sensor 302. A first cepstrum curve 412 is associated with the pump assembly 200 in a healthy functioning state. The first cepstrum curve 412 is characterized by having an amplitude of about eight at quefrency of about zero degrees, and by a rahmonic having an amplitude of about 0.3 at a quefrency of about 120 degrees. A second cepstrum curve 414 is associated with the pump assembly 200 in a partially unhealthy state. The second cepstrum curve 414 is characterized by an amplitude of about seventeen at a quefrency of about zero degrees, and by a rahmonic having an amplitude of about 0.12 at a quefrency of about 120 degrees. A third cepstrum curve 416 is associated with the pump assembly 200 in an unhealthy state. The third cepstrum curve 416 is characterized by an amplitude of about 25 at a quefrency of about zero degrees, and by a rahmonic having an amplitude of about 0.005 at a quefrency of about 120 degrees.

Similarly to cepstrum curves 402, 404, 406 shown in FIG. 12, the cepstrum curves 412, 414, 416 shown in FIGS. 13 and 14 indicate substantial changes in the amplitudes corresponding to decreasing health of the outlet valve 236 of the pump 202. Based on the cepstrum curves 412, 414, 416, the cepstrum amplitude ratios are about 27, 142, and 5000, respectively, and the normalized cepstrum amplitude ratios were calculated to be about 1, 5.3, and 187.5, respectively.

The controller 310 may also determine the amplitude ratios utilizing mean amplitudes of the cepstrum within selected quefrency windows. For example, the controller 310 may determine the mean amplitude of the cepstrum within a quefrency window ranging between about one degree and about five degrees from a quefrency of about zero, and within a quefrency window ranging between about one degree and about five degrees from the selected non-zero quefrency.

It is to be understood that the measurements associated with and shown in FIGS. 12-14 are example measurements performed with an encoder comprising 360 pulses per revolution (corresponding to a resolution of one degree per sample), resulting in an order spectrum sample rate of 360 degrees per revolution. Furthermore, the measurements were performed on a triplex reciprocating pump comprising three fluid chambers 218, three fluid displacing members 222, three inlet valves 228, and/or three outlet valves 236. However, other implementations within the scope of the present disclosure may comprise performing measurements with encoders or other rotary sensors 302 having other sampling rates per revolution on quintuplex reciprocating pumps, comprising five fluid chambers 218, five fluid displacing members 222, five inlet valves 228, and/or five outlet valves 236. Still other implementations within the scope of the present disclosure may comprise performing measurements on reciprocating pumps comprising other quantities of fluid chambers 218, fluid displacing members 222, inlet valves 228, and/or outlet valves 236. Generally, a peak in a sample number of the cepstrum corresponds to a periodicity in the spectrum of sample rate divided by the cepstrum sample number peak. Therefore, to determine a quefrency identifying valve periodicity (i.e., periodicity of a rahmonic peak associated with a pump inlet and/or outlet valve) for different rotary sensors and pumps, the sample rate in degrees per revolution may be divided by the number of inlet and/or outlet valves in the pump, as set forth below in Equation (2).

$$\text{Quefrency Identifying Valve Periodicity} = \frac{\text{Sample rate in degrees per revolution}}{\text{Amount of values}} \quad (2)$$

Utilizing equation (2), for the example measurements performed utilizing the encoder comprising 360 pulses per revolution on the triplex reciprocating pump, the "Quefrency Identifying Valve Periodicity" was calculated to be 120 degrees, as shown in the associated FIGS. 12-14.

Figure 15:
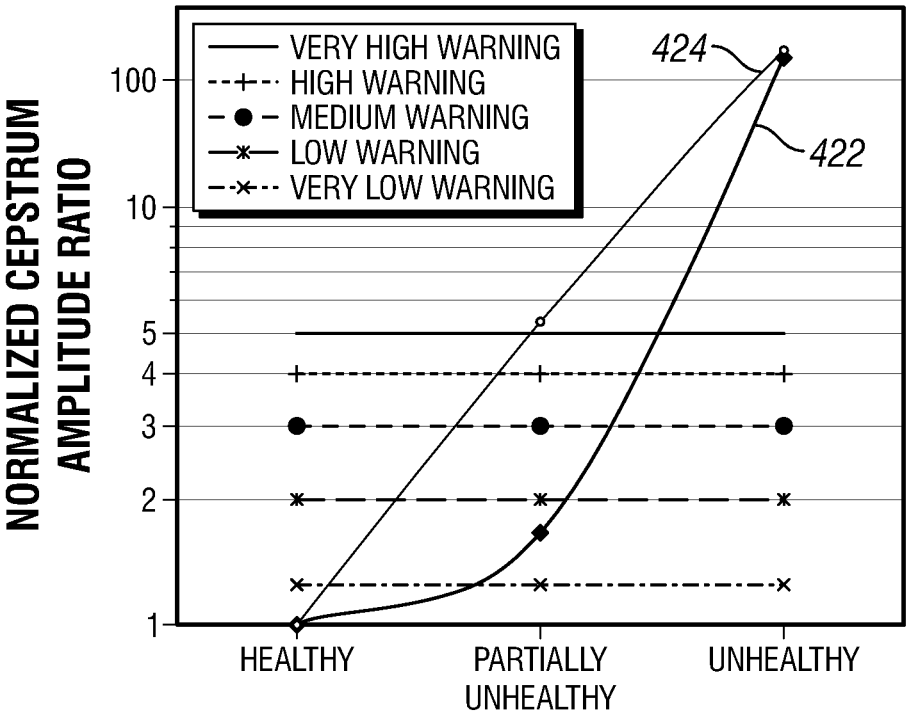

FIG. 15 is a graph of an example implementation of a health assessment tool according to one or more aspects of the present disclosure. The graph shows a range of the normalized cepstrum amplitude ratios along the vertical axis, with the ratios increasing from 1 to about 100. The graph also shows a range of pump health along the horizontal axis, with the pump health decreasing (left-to-right) from healthy (i.e., about 100 percent life remaining) to partially unhealthy (i.e., about fifty percent life remaining) to unhealthy (i.e., about zero percent life remaining). Because there is a relationship between the health of the components of the pump assembly 200 and the normalized cepstrum amplitude ratios, the normalized cepstrum amplitude ratios may be indicative of the level of health of the components of the pump assembly 200. Therefore, the controller 310 may cause the display (e.g., via one or more output devices 328 described above and shown in FIG. 5) of the normalized cepstrum amplitude ratios, whether for inspection by a human operator or otherwise, for determining whether the component should be replaced and/or repaired.

The controller 310 may also be operable to generate warnings when the normalized cepstrum amplitude ratios reach and/or surpass predetermined values during pumping operations and/or over the life of the components of the pump assembly 200. Accordingly, different warning levels may be associated with different values of normalized cepstrum amplitude ratios. For example, in the example implementation depicted in FIG. 15, a "Low Warning" may be associated with a normalized cepstrum amplitude ratio of about two, a "Medium Warning" may be associated with a normalized cepstrum amplitude ratio of about three, a "High Warning" may be associated with a normalized cepstrum amplitude ratio of about four, and a "very high warning" may be associated with the normalized cepstrum amplitude ratio of about five. Each warning may also be associated with a predetermined audio and/or visual output directed to a human operator via one or more output devices 328.

The accuracy of level of health determinations for various components of the pump assembly 200 (hereinafter referred to as the "subsequent pump assembly") may be improved by first generating health or functional life profiles of selected components of another pump assembly (hereinafter referred to as the "logged pump assembly") that is substantially functionally and structurally similar to the subsequent pump assembly 200. The health profiles may be generated over a substantial portion of a functional life of the selected components of the logged pump assembly. After the health profiles are generated, the health levels of the components of the subsequent pump assembly 200 may be continuously or periodically assessed during operations of the subsequent pump assembly 200. In other words, a logged pump assembly may be monitored substantially continuously during its functional life to generate a health profile describing the logged pump assembly "from cradle to grave," and the health profile may subsequently be utilized to assess the health of subsequent pump assemblies that are substantially functionally and structurally similar.

The health profiles may be generated utilizing the same or similar processes, methods, and/or apparatus as described above. For example, a health profile may comprise a record or log of cepstrum amplitude ratios and/or normalized cepstrum amplitude ratios generated by a controller or other processing device over a substantial portion of the functional life of a selected one or more components of the logged pump assembly. The controller or other processing device that generates the health profile spanning the substantial functional life of the logged pump assembly/component may be structurally and/or functionally the same or similar to the controller 310 described above, and perhaps the same physical instance.

FIG. 15 further depicts example pump health profile curves 422, 424 generated during operations of the logged pump assemblies. For demonstrative purposes, the pump health profile curves 422, 424 are based on the data associated with the cepstrum amplitude curves 402, 404, 406 and 412, 414, 416, respectively. The first health profile curve 422 was generated based on the amplitude curves 402, 404, 406 described above and shown in FIG. 12, comprising a normalized cepstrum amplitude ratio of about one when the pump 202 was healthy, a normalized cepstrum amplitude ratio of about 1.7 when the pump 202 was partially unhealthy, and a normalized cepstrum amplitude ratio of about 173.8 when the pump 202 was unhealthy. The second health profile curve 424 was generated based on the amplitude curves 412, 414, 416 described above and shown in FIGS. 13 and 14, comprising a normalized cepstrum amplitude ratio of about one when the pump 202 was healthy, a normalized cepstrum amplitude ratio of about 5.3 when the pump 202 was partially unhealthy, and a normalized cepstrum amplitude ratio of about 187.5 when the pump 202 was unhealthy.

After the health profiles are generated, they may be utilized as a basis for comparison to determine the health status, such as remaining functional life, of selected components of the subsequent pump assembly. For example, the ratios associated with the selected components of the subsequent pump assembly 200 may be compared to the health profile generated for the same or similar component of the logged pump assembly utilized under the same or similar conditions. The position along the health profile where a match is made may be indicative of the remaining functional life of the component. For example, when monitoring a pump that is structurally and/or functionally same or similar to the pump associated with the health profile curve 422, the monitored pump may comprise about 25 percent life remaining when its normalized cepstrum amplitude ratio is about five.

The controller 310 may cause the display of the health profile of a selected component of the logged pump assembly (e.g., via one or more output devices 328 described above and shown in FIG. 5), perhaps superimposed with or otherwise in relation to the normalized cepstrum amplitude ratio(s) of the selected component of the subsequent pump assembly, which may then be utilized to determine whether the selected component of the subsequent pump assembly should be replaced and/or repaired. The controller 310 may also generate warnings based on comparisons between the health profile of the selected component of the logged pump assembly and the normalized cepstrum amplitude ratio(s) of the selected component of the subsequent pump assembly, such as when the normalized cepstrum amplitude ratio of the selected component of the subsequent pump assembly reaches and/or surpasses warning levels (such as the above-described Very Low, Low, Medium, High, and Very High Warnings) that were predetermined based on the health profile of the selected component of the logged pump assembly.

Although the examples described in association with FIGS. 1-15 describe the pump 202 as being a triplex reciprocating pump comprising three fluid chambers 218 and three fluid displacing members 222, other implementations within the scope of the present disclosure may utilize quintuplex reciprocating pumps comprising five fluid chambers 218 and five fluid displacing members 222, or other reciprocating pumps comprising other quantities of fluid chambers 218 and reciprocating or fluid displacing members 222. Thus, for example, when the pump 202 comprises N fluid displacing members, the health of the outlet valves 236, the fluid chambers 218, the displacing members 222, and/or other components may be monitored by examining the amplitude of the rahmonic at a quefrency of about 360/N degrees.

Although the examples described in association with FIGS. 10-15 describe the controller 310 as processing or otherwise utilizing the parameter data in the form of pressure data taken at the fluid outlet cavity 234, other implementations within the scope of the present disclosure may utilize other forms of parameter data, such as pressure fluctuations at the fluid inlet conduit 226, fluid flow fluctuations through the fluid inlet and/or outlet conduits 226, 235, and or vibrations measured at the pump housing 216 or other locations associated with the pump assembly 200. Such parameter(s) may be utilized to generate the cepstrum amplitude ratios, the normalized cepstrum amplitude ratios, and the health profiles, as described above.

Figure 16:
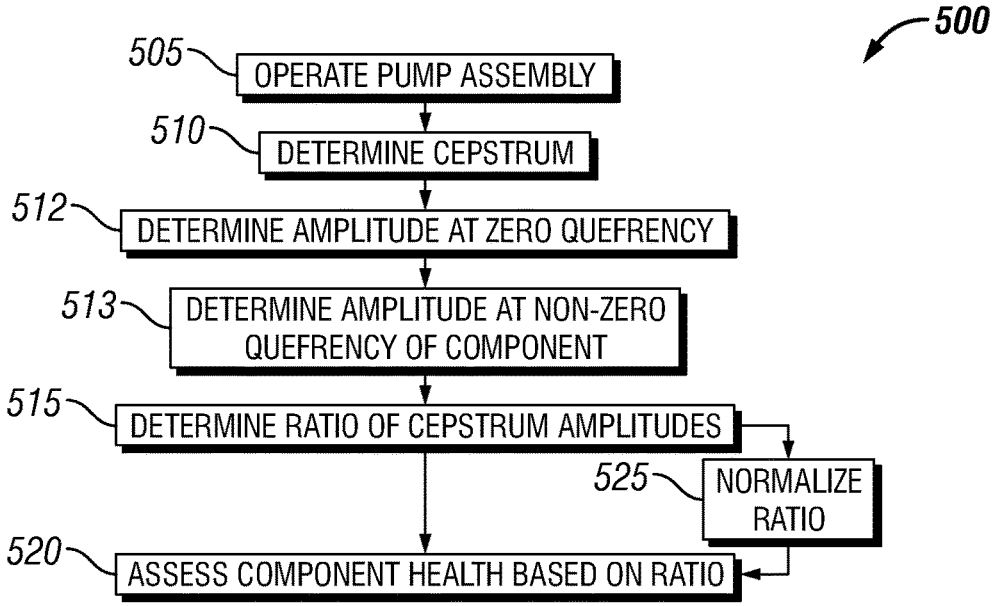
FIG. 16 is a flow-chart diagram of at least a portion of an example implementation of a method according to one or more aspects of the present disclosure.

FIG. 16 is a flow-chart diagram of at least a portion of an example implementation of a method (500) according to one or more aspects of the present disclosure. The method (500) may be performed utilizing at least a portion of one or more implementations of the apparatus shown in one or more of FIGS. 1-5 and/or otherwise within the scope of the present disclosure.

The method (500) may include operating (505) a pump assembly comprising a plurality of components, wherein the plurality of components includes a prime mover and a pump driven by the prime mover. For example, the operated (505) pump assembly may be one of the pump assemblies 200 shown in FIGS. 1-4.

The method (500) comprises determining (510), with respect to an angular position associated with operation (505) of the pump assembly, a cepstrum of a parameter that is associated with the pump assembly and that fluctuates with respect to the angular position, as described above. The method (500) also comprises determining (512) a first amplitude of the determined (510) cepstrum at a quefrency of about zero, determining (513) a second amplitude of the determined (510) cepstrum at a non-zero quefrency corresponding to or otherwise associated with one of the plurality of components of the pump assembly, and determining (515) a ratio of the determined (512) first amplitude to the determined (513) second amplitude. The health of the pump assembly component that is associated with the non-zero quefrency is then assessed (520) based on the determined (515) ratio.

As described above, the determined (510) cepstrum may be an order cepstrum. Determining (510) the cepstrum may utilize Equation (1) set forth above. The non-zero quefrency utilized to determine (513) the second amplitude may coincide with a rahmonic that is associated with the pump assembly component that is associated with the non-zero quefrency. For example, the pump assembly may comprise a pump having N pistons or other fluid displacing members, and the non-zero quefrency may be 360/N degrees. The pump assembly component that is associated with the non-zero quefrency may be a rotating component, an oscillating component, or other component of the pump assembly that exhibits periodic movement, such as in implementations in which the pump assembly comprises a multiplex positive displacement pump.

Determining (512) the first amplitude may include determining a mean amplitude of the determined (510) cepstrum within a quefrency window ranging between about one degree and about five degrees from zero. Determining (513) the second amplitude may include determining a mean amplitude of the determined (510) cepstrum within a quefrency window ranging between about one degree and about five degrees from the non-zero quefrency.

The method (500) may also comprise normalizing (535) the determined (515) ratio based on an initial ratio of the first and second amplitudes determined during initial operation of the pump assembly at the beginning of the operational life of the pump assembly. In such implementations, assessing (520) the health of the pump assembly component associated with the non-zero quefrency may be based on the normalized (535) ratio. For example, assessing (520) the health of the pump assembly component associated with the non-zero quefrency may include determining that the pump assembly component is at least partially defective if a value of the normalized (535) ratio is about two or more.

Assessing (520) the health of the pump assembly component associated with the non-zero quefrency may include estimating a remaining functional life of the component based on the determined (515) ratio. Assessing (520) the health of the pump assembly component associated with the non-zero quefrency may also or instead comprise determining that the component is healthy if the determined (515) ratio is not greater than a predetermined value. Assessing (520) the health of the pump assembly component associated with the non-zero quefrency may also or instead comprise comparing the determined (515) ratio to a set of predetermined values that are each associated with a different one of a set of predetermined health levels, and determining the health level of the pump assembly component based on the comparison. Assessing (520) the health of the pump assembly component associated with the non-zero quefrency may also or instead comprise determining that the pump assembly component is healthy if the determined (515) ratio is not greater than a smallest one of the predetermined values and, if the determined (515) ratio is greater than the smallest one of the predetermined values, determining that the pump assembly component is characterized by the predetermined health level that corresponds to the one of the predetermined values that is closest to the determined (515) ratio.

As described above, assessing (520) the health of the pump assembly component associated with the non-zero quefrency may also or instead comprise identifying that the pump assembly includes a leaking fluid inlet valve, a leaking fluid outlet valve, a leaking seal, an improperly primed fluid chamber, and/or a combination thereof. For example, assessing (520) the health of the pump assembly component associated with the non-zero quefrency may include identifying that the pump assembly component is damaged.

As also described above, the parameter utilized to determine (510) the cepstrum with respect to the angular position associated with operation (505) of the pump assembly may be pressure, vibration, or flow rate. For example, the pump assembly may comprise a pump having a fluid outlet, and the parameter may be fluid pressure at the fluid outlet.

At least a portion of the method (500) may be performed via operation of a processing device according to one or more aspects of the present disclosure. For example, one or more of determining (510) the cepstrum, determining (512) the first amplitude, determining (513) the second amplitude, determining (515) the ratio, assessing (520) the health of the pump assembly component, normalizing (535) the determined (515) ratio, and/or other aspects of the method (500) may be performed via operation of at least one instance of at least a portion of the controller 310 shown in FIG. 5, including implementations included in, in communication with, or otherwise associated with the control center 150 shown in FIG. 1, among other implementations within the scope of the present disclosure. In a similar manner, the parameter and angular position data utilized to determine (510) the cepstrum may obtained via operation of one or more of the rotary sensor(s) 302, the proximity sensor(s) 304, the pressure sensor(s) 306, the pressure sensor(s) 307, the vibration sensor(s) 308, and/or the flow sensor(s) 309 shown in FIG. 5, and/or other sensors described above.

Figure 17:
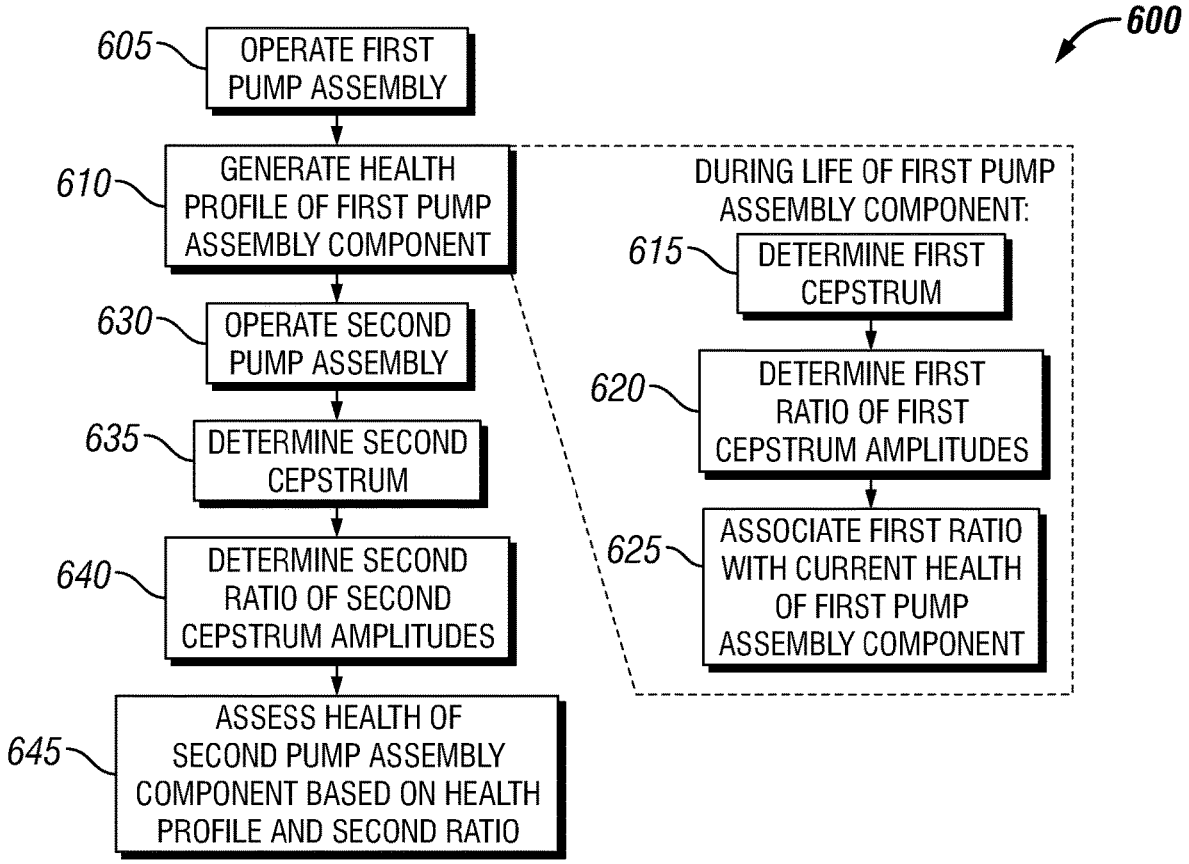
FIG. 17 is a flow-chart diagram of at least a portion of an example implementation of another method according to one or more aspects of the present disclosure.

FIG. 17 is a flow-chart diagram of at least a portion of an example implementation of another method (600) according to one or more aspects of the present disclosure. The method (600) may be performed utilizing at least a portion of one or more implementations of the apparatus shown in one or more of FIGS. 1-5 and/or otherwise within the scope of the present disclosure. One or more aspects of the method (600) shown in FIG. 17 may also be utilized in combination with one or more aspects of the method (500) shown in FIG. 16 within the scope of the present disclosure. For example, one or more aspects of the method (600) shown in FIG. 17 may be substantially the same as, substantially similar to, and/or substantially interchangeable with one or more aspects of the method (500) shown in FIG. 16.

The method (600) includes operating (605) a first pump assembly and generating (610) a health profile of a component of the first pump assembly. For example, the health profile of the first pump assembly component may be generated (610) by, during a substantial portion of a functional life of the first pump assembly component: determining (615), with respect to first angular position data associated with operation (605) of the first pump assembly, a first cepstrum of first parameter data that includes first values of a parameter that is associated with the first pump assembly; determining (620) a first ratio relating a first amplitude of the determined (615) first cepstrum at a quefrency of about zero to a second amplitude of the determined (615) first cepstrum at a non-zero quefrency, wherein the non-zero quefrency is associated with the first pump assembly component; and associating (625) the determined (620) first ratio with a current health of the first pump assembly component.

The method (600) also includes operating (630) a second pump assembly that is substantially functionally and structurally similar to the first pump assembly. The second pump assembly includes a component that is substantially functionally and structurally similar to the first pump assembly component for which the health profile was generated (610). The component of the second pump assembly may be another instance of the first pump assembly component for which the health profile was generated (610). For example, the first pump assembly may comprise a first multiplex positive displacement pump that includes the first component, and the second pump assembly may comprise a second multiplex positive displacement pump that includes the second component, and the first and second components may be different instances of the same component.

The method (600) also includes determining (635), with respect to second angular position data associated with operation (630) of the second pump assembly, a second cepstrum of second parameter data that includes second values of the parameter that was utilized to determine (615) the first cepstrum when generating (610) the health profile of the first pump assembly component. A second ratio is then determined (640), relating a first amplitude of the determined (635) second cepstrum at a quefrency of about zero to a second amplitude of the determined (635) second cepstrum at the non-zero quefrency. The health of the second pump assembly component is then assessed (645) based on the generated (610) health profile and the determined (640) second ratio.

In view of the entirety of the present disclosure, a person having ordinary skill in the art should readily recognize that the present disclosure introduces an apparatus comprising: a monitoring system for assessing health of a pump assembly, wherein the pump assembly comprises a plurality of components that includes a prime mover and a pump driven by the prime mover, and wherein the monitoring system comprises: communication means for receiving: angular position data that includes angular positions that are associated with operation of the pump assembly; and parameter data that includes values of a parameter that is associated with the pump assembly and that fluctuates with respect to the angular positions; and a processing device operable to: determine a cepstrum of the parameter data with respect to the angular position data; and determine a ratio of a first amplitude of the cepstrum at a quefrency of about zero to a second amplitude of the cepstrum at a non-zero quefrency, wherein the determined ratio is indicative of a health of one of the plurality of components. The determined ratio may be indicative of remaining functional life of the one of the plurality of components.

The cepstrum may be an order cepstrum. Determining the cepstrum may utilize Equation (1) set forth above. The non-zero quefrency may coincide with a rahmonic associated with the one of the plurality of components. The pump may comprise N fluid displacing members, and the non-zero quefrency may be 360/N degrees. For example, each of the N fluid displacing members may be a piston.

The processing device may be further operable to: determine the first amplitude by determining a mean amplitude of the cepstrum within a quefrency window ranging between about one degree and about five degrees from zero; and determine the second amplitude by determining a mean amplitude of the cepstrum within a quefrency window ranging between about one degree and about five degrees from the non-zero quefrency.

The processing device may be further operable to: compare the determined ratio to a predetermined value; and indicate the health of the one of the plurality of components based on the comparison.

The processing device may be further operable to: compare the determined ratio to each of a plurality of predetermined values that are each associated with a corresponding one of a plurality of predetermined health levels; and indicate which of the plurality of predetermined health levels characterizes the one of the plurality of components based on the comparison. For example, the plurality of predetermined health levels may include: start of functional life; healthy; partially unhealthy; and unhealthy.

The processing device may be further operable to: compare the determined ratio to each of a plurality of predetermined values that are each associated with a corresponding one of a plurality of predetermined health level warnings; and output each of the plurality of predetermined health level warnings based on the comparison as the pump assembly continues to operate and the determined ratio correspondingly increases to each of the plurality of predetermined values.

The processing device may be further operable to normalize the determined ratio based on an initial ratio of the first and second amplitudes determined during initial operation of the pump assembly at the beginning of the operational life of the pump assembly. In such implementations, the normalized ratio may be indicative of the health of the one of the plurality of components. For example, a value of the normalized ratio of about two or more may be indicative of the one of the plurality of components being at least partially defective. The processing device of such implementations may be further operable to: compare the normalized ratio to a predetermined value; and indicate the health of the one of the plurality of components based on the comparison. The processing device may be further operable to: compare the normalized ratio to each of a plurality of predetermined values that are each associated with a corresponding one of a plurality of predetermined health levels; and indicate which of the plurality of predetermined health levels characterizes the one of the plurality of components based on the comparison. The processing device may be further operable to: compare the normalized ratio to each of a plurality of predetermined values that are each associated with a corresponding one of a plurality of predetermined health level warnings; and output each of the plurality of predetermined health level warnings based on the comparison as the pump assembly continues to operate and the normalized ratio correspondingly increases to each of the plurality of predetermined values.

The parameter data may include pressure data generated by a pressure sensor associated with the pump assembly. The parameter data may also or instead include vibration data generated by a vibration sensor associated with the pump assembly. The parameter data may also or instead include flow rate data generated by a flow rate sensor associated with the pump assembly.

A position sensor associated with the pump assembly may generate the angular position data. The position sensor may comprise at least one of an encoder, a rotational position sensor, a proximity sensor, a linear position sensor, and/or a combination thereof.

The pump may comprise a fluid outlet, the parameter data may include pressure data generated by a pressure sensor associated with the pump assembly, and the pressure data may be related to fluid pressure fluctuations at the fluid outlet.

The indicated health may be associated with at least one of a leaking fluid inlet valve, a leaking fluid outlet valve, a leaking seal, an improperly primed fluid chamber, and/or a combination thereof. The indicated health may also or instead be associated with damage sustained by the one of the plurality of components.

The one of the plurality of components may be a rotating or oscillating component of the pump assembly.

The pump may comprise a multiplex positive displacement pump.

The present disclosure also introduces a method comprising: operating a pump assembly comprising a plurality of components, wherein the plurality of components includes a prime mover and a pump driven by the prime mover; operating a processing device to: determine, with respect to an angular position associated with operation of the pump assembly, a cepstrum of a parameter that is associated with the pump assembly and that fluctuates with respect to the angular position; and determine a ratio of a first amplitude of the cepstrum at a quefrency of about zero to a second amplitude of the cepstrum at a non-zero quefrency; and assessing health of one of the plurality of components associated with the non-zero quefrency based on the determined ratio.

Assessing health may comprise estimating a remaining functional life of the one of the plurality of components based on the determined ratio.

The cepstrum may be an order cepstrum. Determining the cepstrum may utilize Equation (1) set forth above.

The non-zero quefrency may coincide with a rahmonic associated with the one of the plurality of components.

The pump may comprise N fluid displacing members, and the non-zero quefrency may be 360/N degrees. For example, each of the N fluid displacing members may be a piston.

The method may further comprise operating the processing device to: determine the first amplitude by determining a mean amplitude of the cepstrum within a quefrency window ranging between about one degree and about five degrees from zero; and determine the second amplitude by determining a mean amplitude of the cepstrum within a quefrency window ranging between about one degree and about five degrees from the non-zero quefrency.

Assessing health may comprise determining that the one of the plurality of components is healthy if the determined ratio is not greater than a predetermined value.

Assessing health may also or instead comprise: comparing the determined ratio to a set of predetermined values, wherein each of the set of predetermined values is associated with a different health level; and determining the health level of the one of the plurality of components based on the comparison.

Assessing health may also or instead comprise: if the determined ratio is not greater than a smallest one of a plurality of predetermined values each corresponding to a different one of a plurality of predetermined health levels, determining that the one of the plurality of components pump assembly is healthy; and if the determined ratio is greater than the smallest one of the plurality of predetermined values, determining that the one of the plurality of components is characterized by one of the plurality of predetermined health levels that corresponds to the one of the plurality of predetermined values that is closest to the determined ratio.

The method may further comprise operating the processing device to normalize the determined ratio based on an initial ratio of the first and second amplitudes determined during initial operation of the pump assembly at the beginning of the operational life of the pump assembly. In such implementations, assessing health may be based on the normalized ratio. For example, in such implementations, assessing health may comprise determining that the one of the plurality of components is at least partially defective if a value of the normalized ratio is about two or more.

The parameter may be pressure, vibration, or flow rate. For example, the pump may comprise a fluid outlet, and the parameter may be fluid pressure at the fluid outlet.

Assessing health may comprise identifying that the pump assembly comprises at least one of a leaking fluid inlet valve, a leaking fluid outlet valve, a leaking seal, an improperly primed fluid chamber, and/or a combination thereof. Assessing health may also or instead comprise identifying that the one of the plurality of components is damaged.

The one of the plurality of components may be a rotating or oscillating component of the pump assembly.

The pump may comprise a multiplex positive displacement pump.

The present disclosure also introduces a method comprising: operating a first pump assembly; operating a first processing device to generate a health profile of a first component of the first pump assembly by, during a substantial portion of a functional life of the first component: determining, with respect to first angular position data associated with operation of the first pump assembly, a first cepstrum of first parameter data that includes first values of a parameter that is associated with the first pump assembly; determining a first ratio relating a first amplitude of the first cepstrum at a quefrency of about zero to a second amplitude of the first cepstrum at a non-zero quefrency, wherein the non-zero quefrency is associated with the first component; and associating the first ratio with a current health of the first component; operating a second pump assembly that is substantially functionally and structurally similar to the first pump assembly, wherein the second pump assembly comprises a second component that is substantially functionally and structurally similar to the first component; operating a second processing device to: determine, with respect to second angular position data associated with operation of the second pump assembly, a second cepstrum of second parameter data that includes second values of the parameter; and determine a second ratio relating a first amplitude of the second cepstrum at a quefrency of about zero to a second amplitude of the second cepstrum at the non-zero quefrency; and assessing health of the second component based on the health profile and the second ratio.

Assessing health may comprise estimating a remaining functional life of the second component based on the health profile and the second ratio.

The pump may comprise N fluid displacing members, and the non-zero quefrency may be 360/N degrees.

The first amplitude of the first cepstrum may be a mean amplitude of the first cepstrum within a quefrency window ranging between about one degree and about five degrees from zero, and the second amplitude of the first cepstrum may be a mean amplitude of the first cepstrum within a quefrency window ranging between about one degree and about five degrees from the non-zero quefrency. In such implementations, the first amplitude of the second cepstrum may be a mean amplitude of the second cepstrum within a quefrency window ranging between about one degree and about five degrees from zero, and the second amplitude of the second cepstrum may be a mean amplitude of the second cepstrum within a quefrency window ranging between about one degree and about five degrees from the non-zero quefrency.

The parameter may be pressure, vibration, or flow rate.

Assessing health may comprise identifying that the second component is damaged.

The first and second components may be rotating or oscillating components.

The first pump assembly may comprise a first multiplex positive displacement pump that includes the first component, and the second pump assembly may comprise a second multiplex positive displacement pump that includes the second component.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus, comprising:

a monitoring system for assessing health of a pump assembly, wherein the pump assembly comprises a plurality of components that includes a prime mover and a pump driven by the prime mover, and wherein the monitoring system comprises:

communication means for receiving:

angular position data that includes angular positions that are associated with operation of the pump assembly; and parameter data that includes values of a parameter that is associated with the pump assembly and that fluctuates with respect to the angular positions; and a processing device configured to:

determine a cepstrum of the parameter data with respect to the angular position data;

determine a ratio of a first amplitude of the cepstrum at a quefrency of about zero to a second amplitude of the cepstrum at a non-zero quefrency, wherein the determined ratio is indicative of a health of one of the plurality of components, and wherein the non-zero quefrency is inversely proportional to a number of fluid displacing members of the pump; and cause the one of the plurality of components to be replaced, repaired, or both, based on the determined ratio.

2. The apparatus of claim 1 wherein the determined ratio is indicative of remaining functional life of the one of the plurality of components.

3. The apparatus of claim 1 wherein the non-zero quefrency coincides with a rahmonic associated with the one of the plurality of components.

4. The apparatus of claim 1 wherein the pump comprises N fluid displacing members, and wherein the non-zero quefrency is 360/N degrees.

5. The apparatus of claim 1 wherein the processing device is further configured to:

determine the first amplitude by determining a mean amplitude of the cepstrum within a quefrency window ranging between about one degree and about five degrees from zero; and determine the second amplitude by determining a mean amplitude of the cepstrum within a quefrency window ranging between about one degree and about five degrees from the non-zero quefrency.

6. The apparatus of claim 1 wherein the processing device is further configured to:

compare the determined ratio to a predetermined value; and indicate the health of the one of the plurality of components based on the comparison.

7. The apparatus of claim 1 wherein the processing device is further configured to:

compare the determined ratio to each of a plurality of predetermined values that are each associated with a corresponding one of a plurality of predetermined health levels; and indicate which of the plurality of predetermined health levels characterizes the one of the plurality of components based on the comparison.

8. The apparatus of claim 1 wherein the processing device is further configured to:

compare the determined ratio to each of a plurality of predetermined values that are each associated with a corresponding one of a plurality of predetermined health level warnings; and output each of the plurality of predetermined health level warnings based on the comparison as the pump assembly continues to operate and the determined ratio correspondingly increases to each of the plurality of predetermined values.

9. The apparatus of claim 1 wherein the processing device is further configured to normalize the determined ratio based on an initial ratio of the first and second amplitudes determined during initial operation of the pump assembly at the beginning of the operational life of the pump assembly, and wherein the normalized ratio is indicative of the health of the one of the plurality of components.

10. The apparatus of claim 1 wherein the parameter data includes at least one of:

pressure data generated by a pressure sensor associated with the pump assembly;

vibration data generated by a vibration sensor associated with the pump assembly; and flow rate data generated by a flow rate sensor associated with the pump assembly.

11. The apparatus of claim 1 wherein the angular position data is generated by a position sensor associated with the pump assembly, and wherein the position sensor comprises at least one of an encoder, a rotational position sensor, a proximity sensor, a linear position sensor, and/or a combination thereof.

12. The apparatus of claim 1 wherein the pump comprises a fluid outlet, wherein the parameter data includes pressure data generated by a pressure sensor associated with the pump assembly, and wherein the pressure data is related to fluid pressure fluctuations at the fluid outlet.

13. A method, comprising:

operating a pump assembly comprising a plurality of components, wherein the plurality of components includes a prime mover and a pump driven by the prime mover;

operating a processing device to:

determine, with respect to an angular position associated with operation of the pump assembly, a cepstrum of a parameter that is associated with the pump assembly and that fluctuates with respect to the angular position; and determine a ratio of a first amplitude of the cepstrum at a quefrency of about zero to a second amplitude of the cepstrum at a non-zero quefrency, wherein the non-zero quefrency is inversely proportional to a number of fluid displacing members of the pump; and assessing health of one of the plurality of components associated with the non-zero quefrency based on the determined ratio; and replacing, repairing, or both, the one of the plurality of components based on the assessed health.

14. The method of claim 13 wherein assessing health comprises determining that the one of the plurality of components is healthy if the determined ratio is not greater than a predetermined value.

15. The method of claim 13 wherein assessing health comprises:

comparing the determined ratio to a set of predetermined values, wherein each of the set of predetermined values is associated with a different health level; and determining the health level of the one of the plurality of components based on the comparison.

16. The method of claim 13 wherein assessing health comprises:

if the determined ratio is not greater than a smallest one of a plurality of predetermined values each corresponding to a different one of a plurality of predetermined health levels, determining that the one of the plurality of components pump assembly is healthy; and if the determined ratio is greater than the smallest one of the plurality of predetermined values, determining that the one of the plurality of components is characterized by one of the plurality of predetermined health levels that corresponds to the one of the plurality of predetermined values that is closest to the determined ratio.

17. The method of claim 13 further comprising operating the processing device to normalize the determined ratio based on an initial ratio of the first and second amplitudes determined during initial operation of the pump assembly at the beginning of the operational life of the pump assembly, wherein assessing health is based on the normalized ratio.

18. A method, comprising:

operating a first pump assembly;

operating a first processing device to generate a health profile of a first component of the first pump assembly by, during a substantial portion of a functional life of the first component:

determining, with respect to first angular position data associated with operation of the first pump assembly, a first cepstrum of first parameter data that includes first values of a parameter that is associated with the first pump assembly;

determining a first ratio relating a first amplitude of the first cepstrum at a quefrency of about zero to a second amplitude of the first cepstrum at a non-zero quefrency, wherein the non-zero quefrency is associated with the first component, and wherein the non-zero quefrency is inversely proportional to a number of fluid displacing members of the first pump assembly; and associating the first ratio with a current health of the first component;

operating a second pump assembly that is substantially functionally and structurally similar to the first pump assembly, wherein the second pump assembly comprises a second component that is substantially functionally and structurally similar to the first component;

operating a second processing device to:

determine, with respect to second angular position data associated with operation of the second pump assembly, a second cepstrum of second parameter data that includes second values of the parameter;

determine a second ratio relating a first amplitude of the second cepstrum at a quefrency of about zero to a second amplitude of the second cepstrum at the non-zero quefrency; and assessing health of the second component based on the health profile and the second ratio; and replacing, repairing, or both, the second component based on the assessed health.

19. The method of claim 18 wherein assessing health comprises estimating a remaining functional life of the second component based on the health profile and the second ratio.

20. The method of claim 18 wherein:

the first amplitude of the first cepstrum is a mean amplitude of the first cepstrum within a quefrency window ranging between about one degree and about five degrees from zero;

the second amplitude of the first cepstrum is a mean amplitude of the first cepstrum within a quefrency window ranging between about one degree and about five degrees from the non-zero quefrency;

the first amplitude of the second cepstrum is a mean amplitude of the second cepstrum within a quefrency window ranging between about one degree and about five degrees from zero; and the second amplitude of the second cepstrum is a mean amplitude of the second cepstrum within a quefrency window ranging between about one degree and about five degrees from the non-zero quefrency.

* * * * *